US011739996B2

(12) United States Patent
Laughman et al.

(10) Patent No.: US 11,739,996 B2
(45) Date of Patent: Aug. 29, 2023

(54) SYSTEM AND METHOD FOR CALCULATION OF THERMOFLUID PROPERTIES USING SATURATION CURVE-ALIGNED COORDINATES

(71) Applicant: Mitsubishi Electric Research Laboratories, Inc., Cambridge, MA (US)

(72) Inventors: Christopher Laughman, Waltham, MA (US); Scott Bortoff, Brookline, MA (US); Hongtao Qiao, Wakefield, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 0 days.

(21) Appl. No.: 17/651,585

(22) Filed: Feb. 18, 2022

(65) Prior Publication Data

US 2022/0381494 A1 Dec. 1, 2022

Related U.S. Application Data

(60) Provisional application No. 63/191,404, filed on May 21, 2021.

(51) Int. Cl.
*F25B 49/02* (2006.01)
*F25B 19/00* (2006.01)

(52) U.S. Cl.
CPC ..... *F25B 49/02* (2013.01); *F25B 19/00* (2013.01); *F25B 2500/18* (2013.01); *F25B 2500/19* (2013.01); *F25B 2700/19* (2013.01)

(58) Field of Classification Search
CPC .. F25B 49/02; F25B 2500/18; F25B 2500/19; F25B 2600/00; F25B 2700/19; G01N 7/00
See application file for complete search history.

(56) References Cited

U.S. PATENT DOCUMENTS

2003/0182950 A1* 10/2003 Mei ..... F25B 49/005 62/129
2005/0061008 A1* 3/2005 Ben-Nakhi ..... F24F 11/52 62/127

* cited by examiner

*Primary Examiner* — Jonathan Bradford
(74) *Attorney, Agent, or Firm* — Gennadiy Vinokur; Hironori Tsukamoto

(57) ABSTRACT

A system for controlling or optimizing the performance of a vapor compression system by modifying the actuator commands via an output interface, that realizes thermofluid property functions and their derivatives as spline functions which are represented in a coordinate system that is aligned with a fluid saturation curve. The system includes an interface configured to receive measurement data from sensors, a memory configured to store thermofluid property data and computer-executable programs including a B-spline method, and a processor for performing the computer-implemented method. The processor is configured to take as input two thermofluid property variables, and compute a coordinate transformation in which one axis of the coordinates is aligned with the liquid and vapor saturation curves. In the saturation-curve aligned coordinates, a spline function represents the thermofluid property function, with coefficients and knots stored in memory. The spline function is constructed in a manner such that derivatives of the thermofluid property function may be discontinuous across the saturation curve.

22 Claims, 17 Drawing Sheets

SYSTEM AND METHOD FOR CALCULATION OF THERMOFLUID PROPERTIES USING SATURATION CURVE-ALIGNED COORDINATES

FIELD OF THE INVENTION

This invention relates to a system and method for controlling and optimizing the performance of vapor compression systems, more specifically, to a system and method for providing the calculation of thermofluid properties used for the control and performance optimization of vapor compression systems.

BACKGROUND & PRIOR ART

Thermofluid property functions are an essential component of any simulation model of a thermofluid system, such as a vapor compression cycle, and are used in a wide variety of equipment such as air conditioners, heat pumps, refrigerators, and so forth.

Thermofluid property functions relate thermodynamic property variables (such as temperature, pressure, specific enthalpy, and density) and transport property variables (such as viscosity, thermal conductivity, and surface tension) to one another, and provide important physical constraints on the behavior of the system. A property function takes as input a number of independent thermofluid property variables, such as pressure and specific enthalpy, and produces as output a single thermofluid property variable such as density, viscosity, or surface tension. Without accurate thermofluid property functions, a system model used for control or optimization of a thermofluid system will not be consistent with actual system behavior and therefore will be of limited use in solving any practical control or optimization problem.

Thermofluid property variables for a fluid of fixed composition in thermodynamic equilibrium can be calculated as a function of two independent variables: a mixture variable and a second variable. For example, any thermofluid property variable can be calculated as a function of the pressure and the specific enthalpy, or alternatively as a function of the temperature and the specific entropy. Other combinations of independent variables are also possible.

Geometrically, a thermofluid property function can be considered as a two dimensional surface embedded in a three dimensional space, with points on this surface having coordinates consisting of the two input thermofluid property variables, and the one output thermofluid property variable. Mathematically, the domain of a thermofluid property function is defined as the two dimensional span of the two input thermofluid property variables, each over a range of interest which depends on the particular thermofluid system. For many thermofluid systems, such as vapor compression systems, the domain includes values of the two input thermofluid property variables that correspond to one or more of the fluid's states, such as the vapor state, the supercritical state, or the two-phase state (in which both liquid and vapor states are present). The collection of points in the domain for which the fluid is in the liquid state is referred to as the liquid region, the collection of points in the domain for which the fluid is in the vapor state is referred to as the vapor region, the collection of points in the domain for which the fluid is in the two-phase state is referred to as the two-phase region, and the collection of points in the domain for which the fluid is in the supercritical state is referred to as the supercritical region. The boundary between the liquid region and two-phase region in the domain is referred to as the liquid saturation curve. The boundary between the vapor region and two-phase region in the domain is referred to as the vapor saturation curve. These curves intersect smoothly at the critical point of the fluid. Their union is referred to as the saturation curve. The saturation curve is distinguished because its image under a thermofluid property function is, geometrically speaking, a non-smooth edge when considering the thermofluid property function as a surface in three dimensional space. The thermofluid property function is continuous, but not continuously differentiable, for all points on the saturation curve. For all other points in the domain, the thermofluid property function is continuously differentiable as a function of the two input thermofluid property variables.

Control or optimization applications for thermofluid systems often make use of the derivatives of the thermofluid property function with respect to the two input fluid property variables, which are often chosen as output variables of fluid property functions. The derivatives exist and are continuous over the domain except for values of the input thermofluid property variables on the saturation curve. The derivatives are discontinuous at the saturation curve, and the change in the derivative of these output thermofluid property variables across the saturation curve can be several orders of magnitude. For many thermofluid systems, such as vapor compression systems, is important to compute these derivatives accurately at values of the two input thermofluid property variables near the saturation curve, and on both sides of the saturation curve.

Three metrics are of particular interest for thermofluid property functions: accuracy, computational efficiency, and consistency. First, the accuracy of a thermofluid property function is of clear importance, as the function's output thermofluid property variable should closely match experimentally measured data to ensure that system models that use these fluid property functions accurately predict the physical system behavior. Second, thermofluid property functions must also be computationally efficient, as they may be evaluated many times during a computer simulation of a system model. By some estimates, more then 70% of the computation time for a system simulation of a vapor compression system is spent evaluating thermofluid property functions. Improvements in computational efficiency of the thermofluid property functions will therefore have significant benefits by reducing the computational time required for a thermofluid system simulation. For thermofluid system models that have many thousands of equations and variables, reducing simulation time is of important practical value. Third, the thermofluid property variables computed by the thermofluid property functions must be consistent. In a system model, many different thermofluid property functions are used. Some models may make use of various combinations of input thermofluid property variables. All of the thermofluid property functions must compute fluid properties that are consistent with one another. Mathematically, consistency means that the thermofluid property functions have the transitivity property. For example, the density of a fluid can be calculated either as a function of temperature and pressure, or as a function of specific enthalpy and pressure. Further, the specific enthalpy can be computed as a function of the temperature and pressure. The calculation of the density from temperature and pressure should be identical to the density computed from the enthalpy and pressure, where the enthalpy is computed from the temperature and pressure. If this is not the case, the results of a system simulation can be erroneous. Moreover, consistency of derivatives should be enforced as well. For example, the integral of the density derivatives should be equal to the density itself. This is particularly important for vapor compression cycles, as the expression for the mass conservation of the compressible fluid (the refrigerant) is often expressed in terms of the derivatives of density with respect to pressure and specific enthalpy, while other conservation equations (e.g. conservation of energy) incorporate density into their calculations. If the derivatives are numerically approximated, then errors are introduced and consistency of derivatives may not be enforced. Inconsistencies between the density and its derivatives may result in thermofluid system simulation errors.

A few different approaches for computing thermofluid properties exist as prior art. Some approaches are based upon various equations that are derived from the theories of thermodynamics, fluid mechanics, and fluid dynamics. The thermofluid property function may be realized by solving these equations using iterative methods that are intended to converge to a value of the output thermofluid property variable. These methods are realized in available software such as REFPROP and CoolProp. Although these iterative methods are both general and accurate, they are computationally inefficient for use in simulation models that are be used for optimization or control. Furthermore, because these methods are iterative algorithms, they include a stopping criteria, and therefore small errors can be introduced into the computed output thermofluid property value. If these are values that are numerically differentiated in order to compute an approximate derivative, then the small errors can be amplified to the point of being unacceptably large, especially in the region near the saturation curve. Further, these iterative methods can fail to converge for certain values of the two independent thermofluid property variables, and can therefore result in failed simulations. This situation makes these methods unacceptable for use within a control system.

Other approaches for calculating thermofluid property functions for use in simulation include tabular Taylor-series representations or quadratic splines, in which the approximations are constructed as a function of the input thermofluid property variables pressure and specific enthalpy. While such interpolation methods are beneficial because they are more computationally efficient than iterative methods, the output of such methods is prone to severe errors in the region around the saturation curve because they do not take into account the derivative discontinuity at the saturation curve. Furthermore, tabular or quadratic spline methods can produce inconsistent thermodynamic property derivatives, because the derivatives may be numerically approximated. Because the magnitudes of the thermofluid property derivatives may be large in the region near the saturation curve, derivative inconsistency will result in significant deviations between observed system behavior and a system model predictions.

The importance of thermodynamic properties to a wide variety of simulation, control, and optimization problems has motivated a variety of prior efforts to develop fast and accurate methods for calculating these quantities. Aute, et al describe a method for characterizing the refrigerant properties with Chebyshev polynomials that is built from data obtained from REFPROP. This method demonstrates a significant speedup over standard iterative methods, but does not enforce consistency between the properties and their derivatives and cannot represent the behavior of the fluid close to the critical point.

Kunick et al describe a method using quadratic splines to represent the fluid properties of water and steam for the International Association for the Properties of Water and Steam (IAPWS). This method is based upon the use of quadratic splines to approximate an interpolation function in order to reduce the computation time, but has significant differences with the invention described herein. In particular, Kunick et al describe a domain of interest to be the union of three distinct regions of fluid state: a liquid region which covers the full range of pressure and the specific enthalpies in the single phase or supercritical region up to the critical enthalpy $h_c$, a vapor region which covers the full range of pressure and the specific enthalpies in the single phase or the supercritical region above the critical enthalpy $h_c$, and a two-phase region. By splitting up the domain into these three separate non-overlapping domains, the method introduces inconsistencies at the saturation curve between these regions, resulting in errors in the property derivatives near the saturation curve. To address this shortcoming, Kunick et al describe the use of extrapolations to improve accuracy of the derivatives near the saturation curve, but some amount of error in the derivatives cannot be avoided. Kunick et al also state that fluid property variable transformations can improve accuracy of the representation, but these transformations are simple, for the purpose of scaling (e.g., log(P) rather than P), and neither provide consistent thermodynamic property representation over the entire domain of interest, nor capture the discontinuities in derivatives with respect to the fluid property variables near the saturation curve, as is done in the present invention by the use of repeated knots on the saturation curve.

US Patent Application 2020/0050158 describes a thermodynamic property calculation method for the simulation of process control environments that uses a linear approximation of the properties to achieve lower calculation times than may be obtained from conventional iterative methods. While the interest of this patent is also in the computation of thermodynamic properties for process control applications, the approximations made in this patent do not capture the nonlinearities observed in evaporating or condensing flows, nor do they accurately capture the derivatives, especially near the saturation curve.

U.S. Pat. No. 7,676,352 B1 describes a computationally efficient method for calculating thermodynamic properties and their derivatives using local approximations of the thermodynamic properties of the fluid. While the approach does have the advantage of allowing both the properties and their derivatives to be calculated, the local approach used by the method does not describe the global nonlinear fluid property behavior, which is important in many applications such as vapor compression systems. Furthermore, the method does not describe the derivatives accurately in regions close to the saturation curve. In addition, this method uses iteration to compute approximate solutions to a set of nonlinear thermodynamic equations of state when the error grows, which limits its computational efficiency and accuracy.

Consequently, there is a need for a method of calculating thermofluid property variables using thermofluid property functions that has superior performance in terms of accuracy, computational efficiency, and consistency over the domain of interest.

SUMMARY OF THE INVENTION

It is an object of some embodiments to provide a system and method for calculating thermofluid properties for purposes of controlling or optimizing the behavior of a thermofluid system. It is further an object of some embodiments to provide a system and a method for calculating thermofluid properties of a refrigerant for purposes of controlling or optimizing the behavior of a vapor compression system. It is another object of some embodiments to provide a method for using a first thermofluid property variable, a second thermofluid property variable, and a thermofluid property function to calculate a third thermofluid property variable. These thermofluid property variables may be used to describe aspects of the behavior of a thermofluid system in order to determine its performance under a set of conditions. Examples of controllers or optimizers include but are not limited to model predictive control (MPC), which uses a dynamic model of a thermofluid system together with real-time optimization to regulate system performance, or an extended Kalman filter (EKF), which generates optimal estimates of the states of a model of a thermofluid system based upon a set of measurements.

According to some embodiments of the present invention, a control system (controller/optimizer) is provided for controlling a vapor compression system including actuators. The control system may include an input interface configured to receive setpoints of the vapor compression system from a user input and measurement data from sensors arranged in the vapor compression system; a memory configured to store fluid property data of a fluid flowing in the vapor compression system and computer-executable programs including a thermofluid property calculator, a fluid property coordinate transformation, a spline function calculator and a derivative coordinate transformation; and a processor configured to perform steps of: compute, with respect to the setpoints, a pair of input thermofluid property variables from the measurement data or from the stored fluid property data; compute a pair of independent thermofluid property variables from the pair of input thermofluid property variables using the fluid property coordinate transformation, wherein the computed pair of thermofluid property variables is aligned with a saturation curve; compute a third thermofluid property variable using the spline function calculator; compute derivatives of the third thermofluid property variable with respect to the pair of input thermofluid property variables using the spline function calculator and a derivative coordinate transformation;

compute the control data from the measurement data and the third thermofluid property variable and the derivatives of the third thermofluid property variable; and transmit, via an output interface, the computed control data including instructions that control the actuators operating the vapor compression system to the vapor compression system.

Further, some embodiments can provide a computer-implemented method for controlling a vapor compression system including actuators, wherein the method uses a processor coupled with stored instructions implementing the method, wherein the instructions, when executed by the processor carry out at steps of the method, comprising: receiving setpoints of the vapor compression system from a user input and measurement data from sensors arranged in the vapor compression system; computing, with respect to the setpoints, a pair of input thermofluid property variables from the measurement data or from fluid property data stored in a memory; computing a pair of independent thermofluid property variables from the pair of input thermofluid property variables using a fluid property coordinate transformation, wherein the computed pair of thermofluid property variables is aligned with a saturation curve; computing a third thermofluid property variable using a spline function calculator; computing derivatives of the third thermofluid property variable with respect to the pair of input thermofluid property variables using the spline function calculator and a derivative coordinate transformation; computing the control data from the measurement data and the third thermofluid property variable and the derivatives of the third thermofluid property variable; and transmitting, via an output interface, the computed control data including instructions that control the actuators operating the vapor compression system to the vapor compression system.

Some embodiments are based upon the realization that the use of spline functions for thermofluid property function representation ensures consistency of thermofluid property variables and also consistency of derivatives of a thermofluid property function. In this representation, a domain is spanned by two independent variables that are computed from two input thermofluid property variables via one or more coordinate transformations. Each of these two independent variables may be segmented into disjoint intervals, which are joined at points in the domain that are commonly referred to as knots. A spline function and its derivatives are computed at a given pair of input thermofluid property variables by first computing values for the two independent variables, and then computing the output thermofluid property variable from knots and spline coefficients using computationally efficient formulae. This ensures consistency between the thermofluid property variables and their derivatives.

Some embodiments are based upon the realization that the derivatives of a thermofluid property function with respect to input thermofluid property variables are continuous on either side of the saturation curve, and that a thermofluid property function needs be continuously differentiable in these regions without enforcing continuity of the first derivative across the saturation curve. Many extant interpolation schemes attempt to approximate a thermofluid property function with a single, continuously differentiable function over the entire domain of interest, but this introduces significant errors near the saturation curve because of the discontinuity in derivative of the actual thermofluid property function at the saturation curve. This introduces numerical errors that can be unacceptable for purposes of control or optimization.

Accordingly, some embodiments are based on the realization that spline functions can be constructed to have a desired degree of continuity at a set of knot points. In particular, basis spline (B-spline) functions may be constructed that have a degree of continuity equal to an integer p at some knot points, a degree of continuity p+1 on the intervals between those knot points, and a degree of continuity equal to 0 at some other knot points. (A degree of continuity $p \geq 0$ at a point means that derivatives up to order p may be computed at that point. If $p=0$, then the function is continuous at that point, but not continuously differentiable.) Accordingly, some embodiments are based on the realization that B-spline functions can be constructed as a Cartesian product of two independent variables, and the knot points with a multiplicity equal to p can be placed on the saturation curve, such that the resulting B-spline function has a degree of continuity equal to 0 across the saturation curve, p at knot points away from the saturation curve, and p+1 at other points in the domain, respectively.

Some embodiments are based on the realization that one common source for numerical errors, especially in the vicinity of the saturation curve, can be attributed to the fact that the saturation curve is not aligned with either of the two input thermofluid property variables. Accordingly, some embodiments are based on computing one or more changes of coordinates from two input thermofluid property variables to two independent variables, such that one of the independent variables is aligned with the saturation curve. The composite change of coordinates is denoted as the Fluid Property Coordinate Transformation T, and the two independent variables are denoted as saturation curve-aligned variables ($\xi$, $\eta$). Saturation curve-aligned variables ($\xi$, $\eta$) have a geometric property that one of them ($\xi$) is a constant along the saturation curve. Accordingly, some embodiments are based on constructing a B-spline function for the Cartesian cross product of saturation curve-aligned variables ($\xi$, $\eta$), in a manner that the saturation curve is aligned with $\xi$, and in a manner that B-spline knots may be placed on the saturation curve to give the B-spline function a degree of continuity with respect to $\xi$ equal to 0 for values of ($\xi$, $\eta$) on the saturation curve (meaning the B-spline function is continuous but not continuously differentiable at the saturation curve with respect to the variable), while its degree of continuity with respect to ($\xi$, $\eta$) is equal to p at other knot points, and p+1 at other points in the domain, for some integer p>0. For example, for quadratic B-splines, p=2 allowing for derivatives up to degree 1 to be computed for points in the domain not on the saturation curve, while for cubic B-splines, p=3, allowing for derivatives up to order 2 to be computed for points in the domain not on the saturation curve. Note that the degree of continuity p at each knot that is not on the saturation curve may vary from knot to knot, but the single letter p is used herein to simplify the exposition.

Accordingly, one embodiment of the invention defines a Fluid Property Coordinate Transformation to be from two input thermofluid property variables, for example fluid pressure and specific enthalpy, commonly used for vapor compression applications, to fluid pressure, denoted $\eta$ in this embodiment, and thermodynamic quality, denoted $\xi$ in this embodiment. This embodiment of a Fluid Property Coordinate Transformation aligns the saturation curve with the thermodynamic quality axis $\xi$ for values of the fluid pressure below the critical pressure. In this region of the domain, the saturation curve is not connected, and consists of the vapor saturation curve and the liquid saturation curve, which are separated. The liquid saturation curve is aligned with the thermodynamic quality axis at the value $\xi$=0, while the vapor saturation curve is aligned with the thermodynamic quality axis at the value $\xi$=1. This domain is sufficient for many subcritical applications, such as many vapor compression systems that remain subcritical (at pressures below the fluid critical pressure). However, this embodiment cannot be extended to the supercritical region, or a region near the critical point, which is important for some supercritical thermofluid applications.

Accordingly, another embodiment of the invention defines a Fluid Property Coordinate Transformation using normalized polar coordinates, where the normalized radial coordinate $\xi$ is aligned with the saturation curve for values of an input thermofluid property variable above a given lowest value in the domain of interest. In this embodiment, a Fluid Property Coordinate Transformation is constructed as the composition of coordinate transformations, the first of which may scale the two input fluid property variables, the second of which changes to polar coordinate variables, and the third of which normalizes the radial coordinate variable so that the distance from an origin to the saturation curve is a constant value for an input thermofluid property variable above a minimum value of interest. In this embodiment, a B-spline function is constructed in the normalized polar coordinates in a manner that B-spline knots are placed on the saturation curve at a fixed radial distance from an origin to give a degree of continuity 0 with respect to a normalized radial coordinate variable at the saturation curve, while other knots are placed throughout the domain along the normalized radial and axial coordinates to give a degree of continuity equal to p, for some integer $p>^0$, giving a degree of continuity p at all other knots, and a degree of continuity p+1 for all other points in the domain. This embodiment has an advantage that it may include both the subcritical and supercritical regions of the domain.

Accordingly, this invention provides a controller or optimizer of the system that senses a first thermofluid variable and a second thermofluid variable, and inputs this information into a processor. The processor then computes a saturation-curve aligned coordinate transformation, and by using it computes a pair of saturation-curve aligned coordinates. The processor then recalls from memory a set of spline coefficients and knots for a thermofluid property function. These coefficients and knots are then used to compute a third thermofluid property variable and a number of its derivatives. The derivatives may need to be transformed back to the original thermofluid property variables using the Jacobian of the Fluid Property Coordinate Transformation. The third thermofluid property variable and its derivatives may then be used by the controller or optimizer to regulate or govern the behavior of the thermofluid system over an interval of time by determining one or more inputs to the system.

BRIEF DESCRIPTION OF THE DRAWINGS

The accompanying drawings, which are included to provide a further understanding of the invention, illustrate embodiments of the invention and together with the description serve to explain the principle of the invention.

The drawings shown are not necessarily to scale, with emphasis instead generally being placed upon illustrating the principles of the presently disclosed embodiments.

Figure 1:
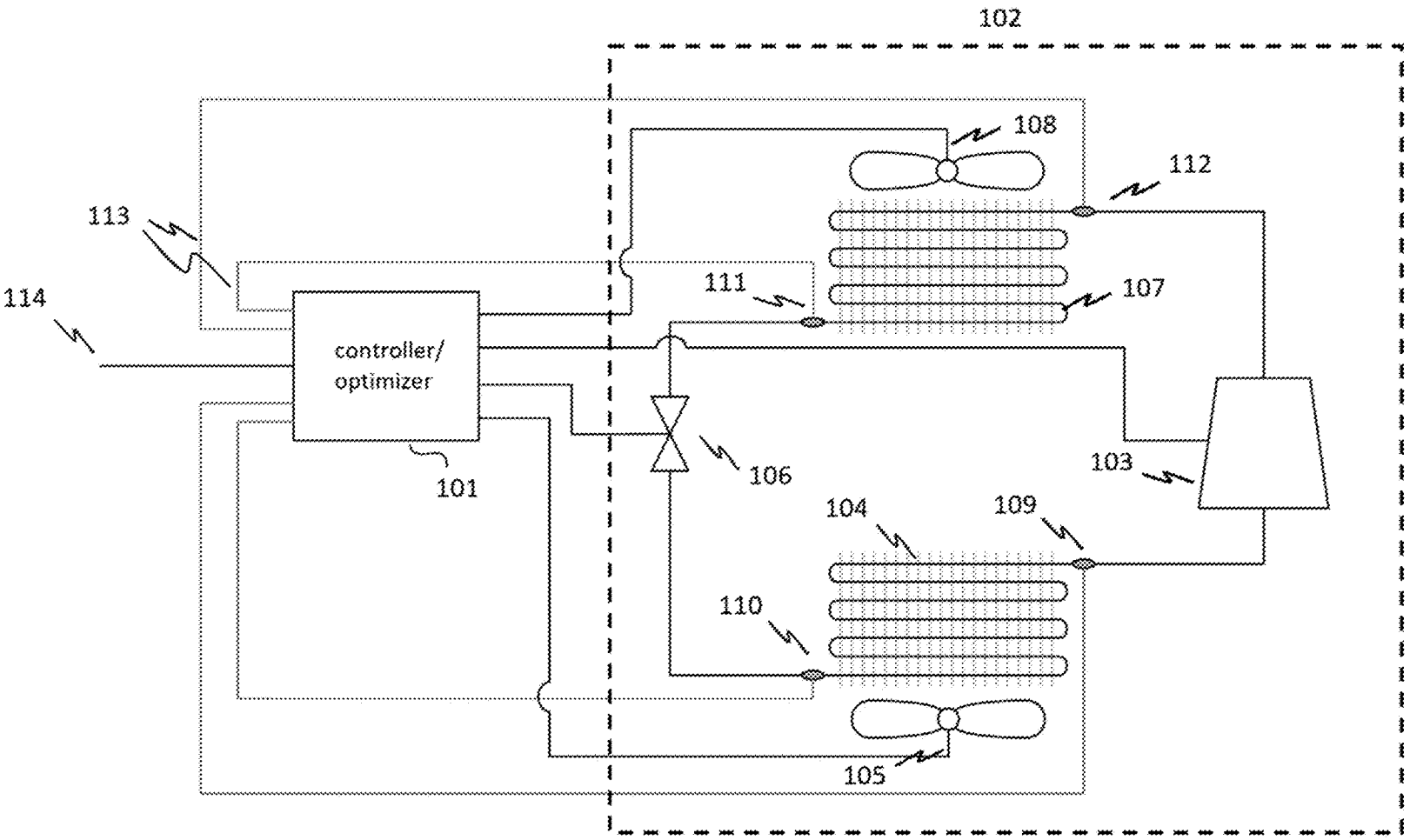
FIG. 1 shows a block diagram of a vapor compression cycle with a controller, sensors, valve, compressor, and heat exchangers, according to embodiments of the present invention.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed embodiments.

DETAILED DESCRIPTION OF THE EMBODIMENTS

Various embodiments of the present invention are described hereafter with reference to the figures. It would be noted that the figures are not drawn to scale elements of similar structures or functions are represented by like reference numerals throughout the figures. It should be also noted that the figures are only intended to facilitate the description of specific embodiments of the invention. They are not intended as an exhaustive description of the invention or as a limitation on the scope of the invention. In addition, an aspect described in conjunction with a particular embodiment of the invention is not necessarily limited to that embodiment and can be practiced in any other embodiments of the invention.

In the following description, for purposes of explanation, numerous specific details are set forth in order to provide a thorough understanding of the present disclosure. It will be apparent, however, to one skilled in the art that the present disclosure may be practiced without these specific details. In other instances, apparatuses and methods are shown in block diagram form only in order to avoid obscuring the present disclosure.

As used in this specification and claims, the terms "for example," "for instance" and "such as," and the verbs "comprising," "having," "including," and their other verb forms, when used in conjunction with a listing of one or more components or other items, are each to be construed as open ended, meaning that the listing is not to be considered as excluding other, additional components or items. The term "based on" means at least partially based on. Further, it is to be understood that the phraseology and terminology employed herein are for the purpose of the description and should not be regarded as limiting. Any heading utilized within this description is for convenience only and has no legal or limiting effect.

Heat pumps, air conditioners and refrigerators are examples of devices that move heat from one or more physical locations to other locations in order to achieve desirable thermal conditions at one or more of these locations. Most heat pumps employ a vapor compression cycle to move heat. Operation of a vapor compression cycle may be described using a variety of thermofluid property variables, such as temperature, pressure, humidity, enthalpy, density, viscosity, etc. It is desirable to operate a vapor compression cycle in a manner that satisfies various operational constraints, such as maintaining certain thermofluid property variables below each of their respective maximum limits in order to prevent damage to the vapor compression cycle equipment. It is also desirable to operate a vapor compression cycle in order to cause some thermofluid property variables, such as temperature or pressure, to remain near desirable setpoints, despite disturbances that may act on the vapor compression system such as changes in ambient temperature. It is also desirable to operate a vapor compression cycle in a manner that minimizes power consumption.

Generally, a vapor compression cycle (system) is connected to a controller or optimizer that adjusts actuators, such as a compressor speed, valve settings, or fan speeds, in order to achieve a desirable operating performance. A controller may obtain information about a vapor compression cycle via sensors that may be installed on or near the vapor compression cycle in order to measure characteristics of the vapor compression cycle or its environment, including some thermofluid property variables. Examples of such sensors are temperature sensors or pressure sensors. A controller may perform some computation based on one or more sensor measurements in order to calculate values for one or more actuators of the vapor compression cycle, such that a desired performance objective is satisfied. Many different performance objectives may be defined, such as the objective of regulating a setpoint or minimizing power consumption of the vapor compression cycle while maintaining a thermofluid variable within a desirable range. Additionally, a controller may also need to satisfy specified performance objectives, such as ensuring that certain thermofluid variables remain below certain limits. This information may be incorporated into a calculation of actuator values. Such considerations are particularly important for vapor compression cycles that have variable-position actuators, such as variable speed compressors or fans, since poorly chosen combinations of actuator values can result in performance degradation or reduce the useful lifetime of system components.

Many different types of controllers may be formulated, depending on the desired objective for system performance. To predict a behavior of a vapor compression cycle in steady-state conditions, or dynamically over a time horizon, a set of mathematical equations which may include a number of differential equations and a number of algebraic equations, describing mass transfer, momentum balance, energy conservation, and various closure and correlation relationships known to those skilled in the art may be used in a controller in order to control or optimize the operation of a vapor compression cycle. Herein, such a set or subset of such equations is referred to as a model of a system.

For example, a candidate control architecture referred to as "model predictive control" (MPC) uses a model of a vapor compression cycle to predict its behavior over a time horizon. An MPC periodically samples one or more sensors and computes values for one or more actuators by minimizing a mathematical objective function that is defined over a time horizon and represents a desirable operational performance, subject to a constraint that the solution satisfies the model equations, and possibly some additional operational constraints. This procedure may be repeated in a receding horizon fashion. The model used in such a framework may be based on the physics of a vapor compression cycle and may require thermofluid property variables that are not directly measurable, and are therefore calculated via some thermofluid property variable calculation method. For example, such a method may measure the temperature and pressure of a fluid in a vapor compression cycle and calculate the specific enthalpy of the fluid from those measurements, from which the amount of heating and cooling produced by the cycle may be calculated and used to control or optimize the system.

A thermofluid property variable for a fluid of fixed composition in thermodynamic equilibrium can be calculated as a function of two other independent thermofluid property variables. For example, any thermofluid property variable can be calculated as a function of the fluid pressure and the fluid specific enthalpy, or alternatively as a function of the fluid temperature and the fluid specific entropy. Many combinations of independent variables are possible, and various combinations have advantages in terms of numerical efficiency depending on the particulars of a system model or a need to compute various quantities of interest such as a heat flux. Therefore, a function that relates two thermofluid property variables to a third thermofluid property variable, referred to herein as a thermofluid property function, is critical to models of vapor compression cycles, and such functions appear frequently in a set of differential and algebraic equations that comprise a model of a thermofluid system, such as a vapor compression cycle.

Mathematical derivatives of thermofluid property functions are often used in models, which are used often in controllers or optimizers of a vapor compression systems. Moreover, certain thermofluid property variables may be preferred over others as state variables of a model, because they lead to more efficient numerical solutions of a model. For example, the mass conservation equation for a compressible volume of fluid may be expressed as $$\frac{dM}{dt} = \dot{m}_{in} - \dot{m}_{out}, \tag{1}$$

where M is the mass of the fluid in the volume, $m_{in}$ is the flow rate into the volume, and $m_{out}$ is the flow rate out of the volume. However, M is seldom used as a state variable of a vapor compression cycle model because it is numerically inefficient to calculate other thermofluid property variables of interest from this variable. Rather, fluid pressure P and specific enthalpy h are preferred because it is more efficient to calculate other thermofluid property variables from them, and because many of the quantities of interest for the cycle, such as the amount of cooling provided at a point in time, can be directly calculated from P and h. As a result, fluid mass conservation for a vapor compression cycle is often expressed in terms of fluid density ρ, rather than M, with the equation $$V\left(\frac{d\rho}{dP}\frac{dP}{dt} + \frac{d\rho}{dh}\frac{dh}{dt}\right) = \rho_{in}v_{in}A_{in} - \rho_{out}v_{out}A_{out}, \tag{2}$$

where V is the fluid volume, $v_{in}$ is the fluid velocity at the inlet, $v_{out}$ is the fluid velocity at the outlet, $A_{in}$ is the inlet port area, and $A_{out}$ is the outlet port area. The importance of derivatives of the fluid property variables, $\partial\rho/\partial P$ and $\partial\rho/\partial h$, and of derivatives of fluid property functions that relate thermofluid property variables to one another, can thus be seen to be an essential aspect of this model, and an essential aspect to a numerical solution computed using a model, and an essential aspect to optimization and control of a vapor compression system that uses a model.

Alternatively, a controller may dynamically optimize vapor compression system behavior using a model. Gradient-based optimization methods, such as the family of approaches related to Newton's method, have been shown to effectively identify optimizers of nonlinear problems through iterative refinement of an initial guess by using the first and second derivatives of a model-based cost function. Representative applications include calibration methods that seek to identify best-fit parameter values of a predictive model on the basis of system measurements or system tuning methods that seek to estimate the optimal mass of refrigerant in a vapor compression cycle based on data. Because gradients used by these methods include derivatives of thermofluid property variables, accurate derivative computations of thermofluid property variables, and accurate realizations of derivatives of thermofluid property functions, are essential to obtain accurate results from these algorithms.

Alternatively, models of vapor compression systems find many uses in computer simulation. Many physics-based simulation models for vapor compression cycles are based upon computing numerical solutions to one or more differential equations and one or more algebraic equations that describe the behavior of a vapor compression cycle. The numbers of these equations and associated thermofluid property variables may be very large and numerically ill-conditioned. As a result, these equations may have to be solved many times in the course of a computer simulation. It is therefore important that these equations are numerically efficient, so as to reduce the time required to complete a computer simulation.

In these and other cases, it is important that thermofluid property functions and variables, and their derivatives, be computed accurately, efficiently, and consistently. Accuracy of a thermofluid property variable or a thermofluid property function means that the prediction of a model corresponds to measured or observed behavior, and that the thermofluid property variable or thermofluid property function satisfies physical conservation laws such as the conservation of mass, energy and momentum. In addition, models used in a controller or optimizer may make use of a large number of thermofluid property function evaluations. A thermofluid property function calculation must be numerically efficient because its calculation must be completed under a strict time budget in order to run within a controller or optimizer in real time. Additionally, as is evident from the above discussion, a vapor compression cycle model often includes thermofluid property variables, thermofluid property functions, and derivatives of both thermofluid property variables and thermofluid property functions with respect to other thermofluid property variables. Because many different fluid property variables may be used within a model, it is important that the derivatives are consistent, meaning they have the mathematical property of transitivity, and also that derivatives of thermofluid property variables are accurate, meaning integration of a derivative gives back the same value. Numerical approximations to derivatives may lack consistency, and also accuracy, giving rise to errors in a model.

Accurate and consistent methods for representing thermofluid property functions must accurately represent the discontinuity in thermofluid property variables at the liquid and vapor saturation curves that are associated with the transition between the single-phase fluid state and the evaporating or condensing (two-phase) fluid state. This is especially true for models of vapor compression systems, because their operation depends fundamentally on this transition, and models of vapor compression systems evaluate thermfluid property functions on both sides, and very near to the saturation curve. The discontinuity in the derivatives of thermofluid property functions at the liquid and saturation curve can be significantly large to affect the solution to a model. For example, calculating the derivative of density with respect to specific enthalpy for a model of a pure fluid in the single-phase region is $$\left(\frac{\partial \rho}{\partial h}\right)_p = -\frac{\beta \rho}{c_p}, \tag{3}$$

where $\beta$ is the coefficient of thermal expansion, and $c_p$ is the specific heat capacity at constant pressure. In comparison, the derivative of density with respect to specific enthalpy at constant pressure in the two-phase region is $$\left(\frac{\partial \rho}{\partial h}\right)_p = -\rho^2 \frac{v_g - v_f}{h_g - h_f}. \tag{4}$$

The values for these expressions differ at the saturation curve, which indicates the presence of a discontinuity in the derivatives of the thermofluid property functions. Methods that represent a thermofluid property function that are smooth at the saturation curve, i.e., that have a continuous derivative of a fluid property variable across the saturation curve, will result in derivatives of the fluid property function on either side of the saturation curve that have errors, which can be severe and can result in erroneous model behavior.

One realization of this invention is that representing thermofluid property functions via B-spline functions addresses the need for accuracy, numerical efficiency, and consistency. Univariate (single-variable) spline functions are piecewise polynomial functions defined on a domain of interest $\Omega \in R$. The domain $\Omega$ is segmented into disjoint intervals. On each interval, a spline function is a polynomial of degree p+1. At the ends of each interval, called a knot point, the two adjoining polynomials are identical, and their derivatives are identical, up to and including their $d^{th}$ derivative, where $d \leq p$. If the two adjoining polynomials agree at the $(p+1)^{th}$ derivative, then the two polynomials are the same, so there is no knot joining them. B-splines (basis splines) are a representation of spline functions that make use of a numerically efficient set of basis functions, based on the realization that spline functions of a given degree for a given set of knots are a linear vector space.

Denote the set of knots in a domain $\Omega=[a, b]$ as $$U = \{\underbrace{a, \ldots, a}_{p+1}, u_{p+1}, \ldots, u_{m-p-1}, \underbrace{b, \ldots, b}_{p+1}\}, \tag{5}$$

where the knot points satisfy $u_i \leq u_{i+1}$, $i=0, \ldots, m-1$. Note that the knots at the ends, a and b, are repeated p+1 times, which is required by the formulae to be presented below. Other knots in the interior of $\Omega$ may also be repeated. If a knot is repeated $l \leq p$ times, it is said to have multiplicity l.

The $i^{th}$ B-spline basis function of degree (or order) p+1, denoted by $N_{i,p}(u)$, can be computed recursively by the Cox-de Boor formula as $$N_{i,0}(u) = \begin{cases} 1 & \text{if } u_i \leq u < u_{i+1} \\ 0 & \text{otherwise} \end{cases} \tag{6}$$

$$N_{i,p}(u) = \frac{u - u_i}{u_{i+p} - u_i} N_{i,p-1}(u) + \frac{u_{i+p+1} - u}{u_{i+p+1} - u_{i+1}} N_{i+1,p-1}(u). \tag{7}$$

These functions have finite support, meaning only the basis functions from the p+1 Intervals around a given point u are nonzero, so that the computation of the B-spline basis has a fixed cost, is numerically efficient, and is well conditioned regardless of the size (m+1) of the knot set. Derivatives of B-spline basis functions are given by $$N'_{i,p} = \frac{p}{u_{i+p} - u_i} N_{i,p-1}(u) - \frac{p}{u_{i+p+1} - u_{i+1}} N_{i+1,p-1}(u), \tag{8}$$

so that derivatives of the basis functions can be computed directly from the basis functions themselves.

A B-spline function f(u) is a linear combination of the B-spline basis $$f(u) = \sum_{i=0}^{n} c_i N_{i,p}(u), \tag{9}$$

where $n=m-p-1$ and $c_i \in R$ is a spline coefficient, for $0 \leq i \leq n$. For notational compactness, define the coefficient vector as $c=[c_0, c_1, \ldots, c_n]^T \in R^{n+1}$. At knots of multiplicity l, a spline function will be continuous, and the first p–l derivatives will be continuous. In other words, at knots of multiplicity l, a spline function will be $C^{p-l}$ at that knot point, and $C^{p-l+1}$ on the intervals around that knot. However, the (p–l+1)-th derivative may be discontinuous at that knot, depending on the coefficients. Therefore, by setting the multiplicity of a knot to be l=p, any Spline function will be C.° at that knot, meaning it will be continuous, but not continuously differentiable.

Multivariable B-splines are defined simply by the Cartesian product of each of the univariate domains. For example, the two-dimensional B-spline function $f(u,v):R^2 \rightarrow R$ is represented as $$f(u, v) = \sum_{i=0}^{n_u} \sum_{j=0}^{n_v} c_{ij} N_{i,p}(u) N_{j,p}(v), \tag{10}$$

where the coefficient $c_{ij} \in R$, for $0 \leq i \leq n_u$, $0 \leq j \leq n_v$. In this case, the coefficient matrix C may be defined as $C=[c_{ij}]$.

In order to calculate thermofluid property variables, and order to represent thermofluid property functions and compute their derivatives accurately efficiently and consistently, the present disclosure describes methods that are suitable for inclusion in a simulator, controller, or optimizer. This method is based upon the realization that there are many tangible benefits of aligning the coordinate system with the saturation curve, particularly for the purpose of accurately and efficiently calculating derivatives of thermofluid property variables. These methods are also based upon the realization that B-spline-based methods that enable the calculation of the derivatives directly from the a set of coefficients that are used to compute thermofluid property functions, which is valuable because it ensures consistency between variables derivatives, and also because of its memory efficiency. These methods are also based upon the realization that a proper representation of thermofluid property functions must be able to accurately represent the discontinuity in derivatives caused by fluid phase change.

While two distinct embodiments are examined herein, both manifest common characteristics of the underlying invention. Specifically, both embodiments align a coordinate system with the saturation curve, and both embodiments use B-splines to represent thermofluid property functions because they enable the calculation of derivatives that are accurate and consistent. One embodiment uses a coordinate transformation to a Cartesian coordinate system that is aligned with the saturation curve, while the other uses a polar coordinate transformation to polar coordinates that are aligned with the saturation curve. The first of these embodiment will be called the "Cartesian transformation embodiment," while the second is called the "normalized polar coordinates embodiment."

FIG. 1 shows a block diagram of a vapor compression cycle with a controller, sensors, valve(s), compressor, fans, and heat exchangers. In some cases, the vapor compression cycle may be referred to as a vapor compression system or a vapor compression circuit, and the controller may be referred to as an optimizer. The sensors, valve(s), compressor, and heat exchangers are arranged in the vapor compression circuit. The controller is configured to receive the measurement data from the sensors while the vapor compression system is operating. The controller controls the valves, the compressor and the heat exchangers to achieve a predetermined condition of a fluid that flows in the vapor compression circuit.

The figure illustrates a diagram of a vapor compression system 102 with variable actuators which also incorporates a controller 101 that regulates its behavior. The vapor compression cycle (system) 102 comprises, at a minimum, a set of four components: a compressor 103, a condensing heat exchanger 104, an expansion device 106, and an evaporating heat exchanger 107. Heat transfer from the condensing heat exchanger is promoted by use of fan 105, while heat transfer from the evaporating heat exchanger 107 is promoted by the use of fan 108. This system has variable actuators, such as a variable compressor speed, variable expansion valve position, and variable fan speeds. Of course, there are many other alternate equipment architectures to which this invention pertains with multiple heat exchangers, compressors, valves, and other components such as accumulators or reservoirs, pipes, and so forth, and the discussion of a simple vapor compression cycle is not intended to limit the scope or application of this invention to systems whatsoever.

The function of a vapor compression cycle is well-known, but is described briefly here. The variable speed compressor 103 compresses a low pressure, low temperature vapor-phase fluid called the refrigerant to a high pressure, high temperature vapor state, after which it passes into the condensing heat exchanger 104. As the refrigerant passes through this heat exchanger, the enhanced heat transfer promoted by variable speed fan 105 causes the high-temperature, high pressure refrigerant to transfer its heat to the ambient air, which is at a lower temperature. As the refrigerant transfers thermal energy to the ambient environment, it gradually condenses until all of the refrigerant is in a high pressure, low temperature liquid state. After it leaves the condensing heat exchanger 104, the refrigerant passes through a variable orifice expansion valve 106 and expands to a low pressure boiling state, from which it enters an evaporating heat exchanger 107. Because the air passing over the evaporating heat exchanger is warmer than the refrigerant itself, this refrigerant gradually evaporates as it passes through this heat exchanger, so that it completely evaporates before it exits at a low pressure, low temperature state. The evaporation process is further facilitated by the enhanced heat transfer promoted by variable speed fan 108. The refrigerant reenters the compressor in this low pressure, low temperature state, at which point the cycle repeats.

In this system, the controller 101 is configured to transmit control data including instructions that control operations of actuators, such as the components 103, 105, 106, and 108 of the vapor compression system 102 including compressors, valves and motor fans to achieve the performance of a vapor compression system 102 in response to the setpoints inputted via an interface by a user input. The controller 101 obtains measurements from sensors about the state of the system that is used to provide information about its performance. Sensor 109 indicates the use of temperature, pressure, or other sensors to measure the state of the refrigerant entering the condensing heat exchanger, while sensor 110 indicates the use of similar measurement modalities to measure the state of the refrigerant leaving the condensing heat exchanger. Similarly, sensor 111 measures the state of the refrigerant entering the evaporating heat exchanger, while sensor 112 measures the state of the refrigerant exiting the evaporating heat exchanger. The controller or optimizer then uses these measurements 113 to evaluate the operation of the system according to factory-provided setpoints 114 inputted by a user using an input interface, and modifies the value of actuator inputs 103, 105, 106, and 108 according to the measurements and the specified objectives or constraints that are possessed by the controller. As before, these indicated measurements and architecture are not intended to be limiting, but rather indicate the overall structure of such systems.

Figure 2:
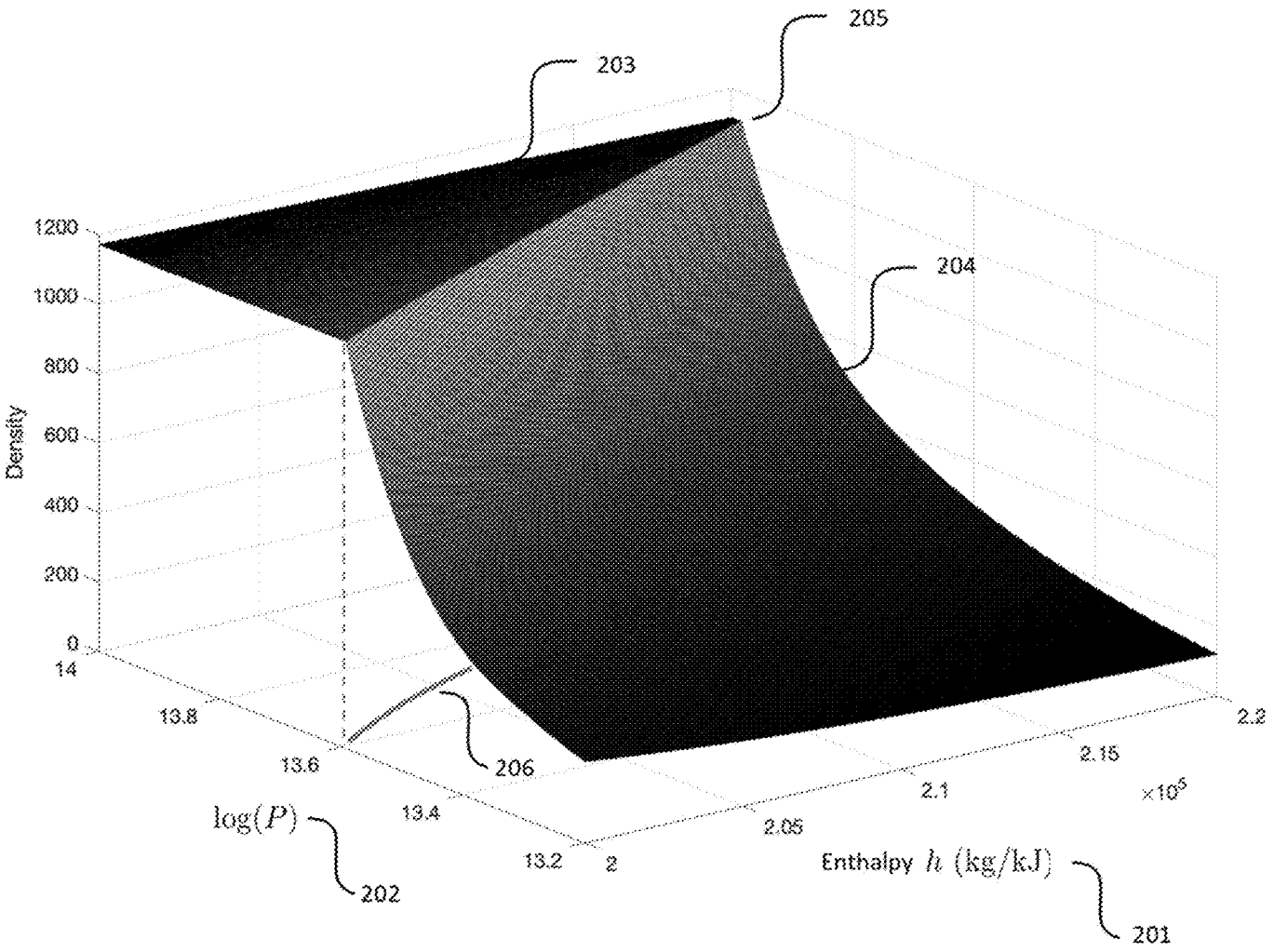
FIG. 2 shows a plot of the fluid density surface for refrigerant R410A as a function of the two independent thermofluid variables specific enthalpy (h) 201 and log of pressure (log(P)), showing the edge at the transition between the single-phase density and the two-phase density, along the saturation curve, according to embodiments of the present invention.

FIG. 2 shows a plot of the fluid density surface for refrigerant R410A as a function of the two independent thermofluid variables specific enthalpy (h) 201 and log of pressure (log(P)) 202, showing the edge 205 at the transition between the single-phase density 203 and the two-phase density 204, along the saturation curve 206. The figure illustrates, as an example, the variation of the density for the common refrigerant R410A as a function of the specific enthalpy 201 and the logarithm of the pressure 202 to illustrate the existence of derivative discontinuities at the liquid saturation curve 205. The density in the liquid region 203 can be seen to be smooth, as is the density in the two-phase region 204. The saturation curve 205 lies in the plane 206 spanned by the two independent fluid property variables h and P. The density along the saturation curve may be interpreted as a non-smooth edge by interpreting the density function as a two-dimensional surface embedded in three-dimensional space. The surface is continuous across the saturation curve, but its derivatives are discontinuous along a path from one region to the other. It is an objective of this invention to accurately describe the saturation curve 205 and the associated derivative discontinuities.

Figure 3:
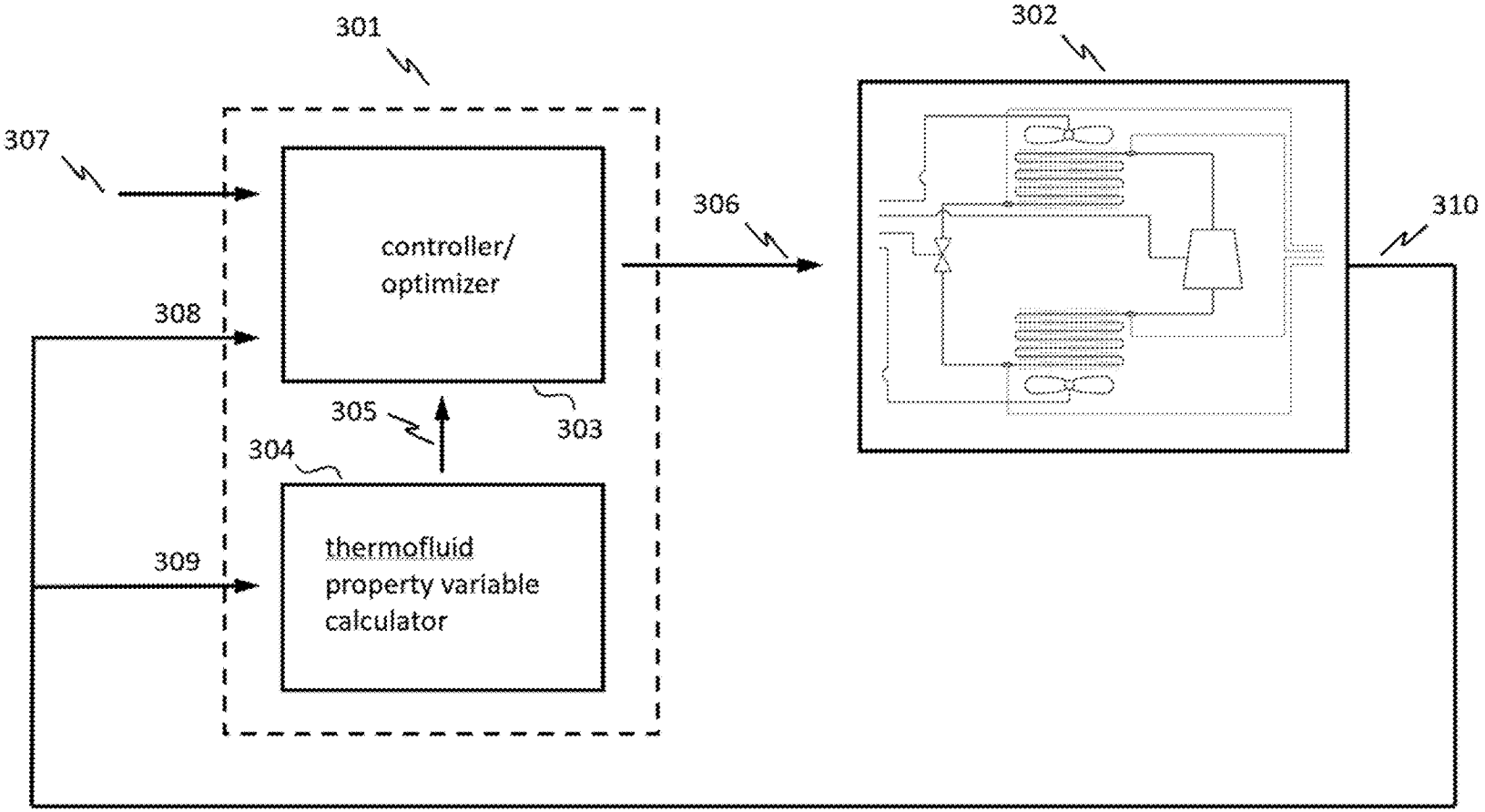
FIG. 3 shows a block diagram of the controller illustrating the use of the thermofluid property variable calculator supplying thermofluid property variables 305 for use by the control controller/optimizer 303 in order to modify the behavior of the vapor compression cycle, according to embodiments of the present invention.

FIG. 3 shows a block diagram of the controller 301 illustrating the use of the thermofluid property variable calculator 304 supplying thermofluid property variables 305 for use by the control controller/optimizer 303 in order to modify the behavior of the vapor compression cycle 302. The figure illustrates the structure of a specific controller or optimizer 301 for a vapor compression cycle (circuit) 302 that has two distinct components: a control block 303 and a thermofluid property calculation block 304. Measurements of this system 310 are obtained and this subsets of this information are passed to the control block 303 and the thermofluid property calculation block 304. The control block 303 is configured to receive user input 307 and system information 308 and calculate the actuator inputs 306. A variety of different methods may be used in the control block, such as proportional-integral (PI) controllers or a gradient-based optimization algorithm. This block 303 does rely upon information about the system that is not immediately available from the measurements 308. For example, model predictive control (MPC) uses information from a model of the system to predict the behavior of the system over a time horizon and then optimize the actuator inputs to satisfy an objective function and operating constraints. This information about the system 305 is provided by the thermofluid property calculation block 304, which may compute a variety of thermofluid property functions and thermofluid property variables that are used in the control block 303. The thermofluid property computation block 304 may compute this property information from a set or subset of the system measurements 309. Alternatively, the control block 303 may consist of an optimization algorithm that is designed to optimize the system performance according to some metric. In this case, the gradient of the model at the given operating point is needed to optimize the system behavior. These methods therefore require the fast, accurate, and consistent implementation of thermofluid property functions so that they can be used in real-time by the controller 303.

In this invention, some embodiments of thermofluid property functions are described. Either may be used in a controller or optimizer (illustrated as controller/optimizer 101 in FIG. 1, controller/optimizer 303 in FIG. 3 or controller 1704 in FIG. 17) or with a set of measurements from the physical system (sensors 110, 111 and 112 in FIG. 1 or sensors 1709 in FIG. 17). Also described is the process of constructing the embodiments of thermofluid property functions from available data.

Figure 4:
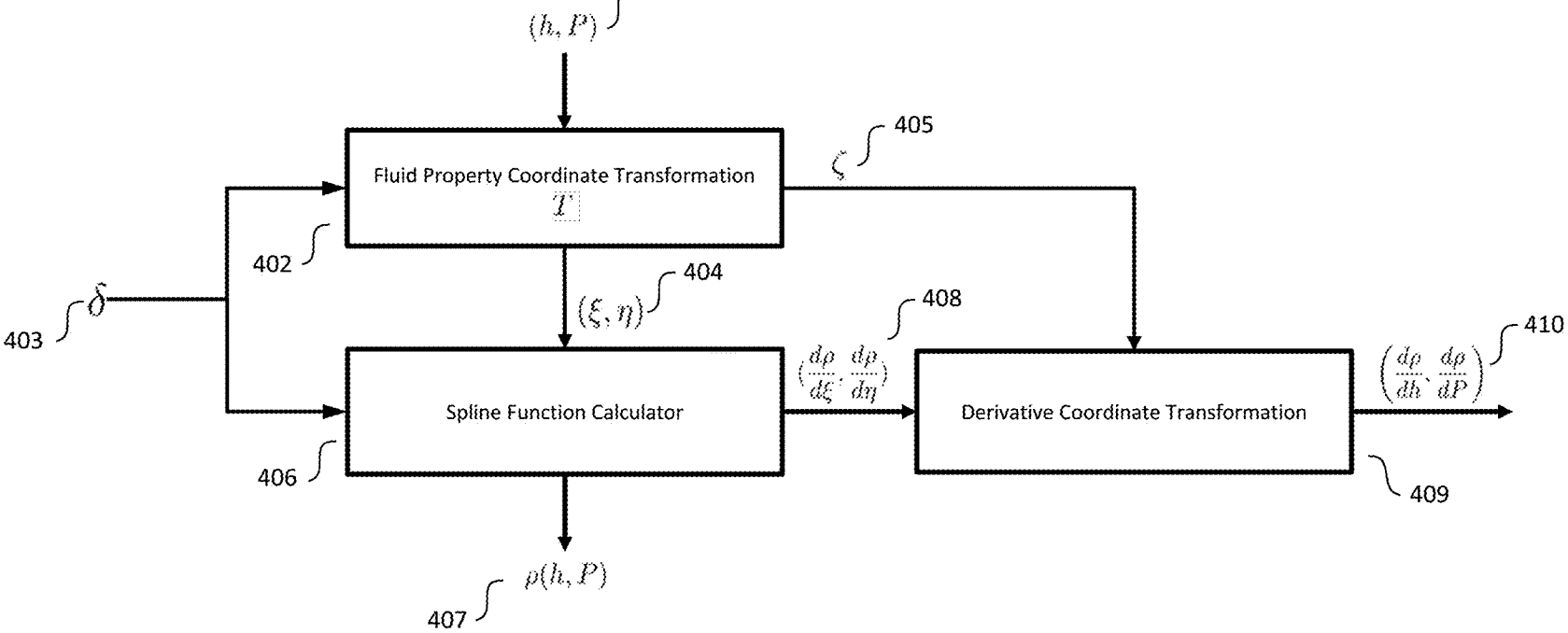
FIG. 4 shows a block diagram of the thermofluid property function calculation using the methods of saturation curve-aligned coordinates, according to embodiments of the present invention.

FIG. 4 shows a block diagram of the thermofluid property function calculation using the methods of saturation curve-aligned coordinates, consisting of the Property Coordinate Transformation 402, which acts on the two independent thermofluid variables 401 and data 403 to produce independent thermodynamic variables in the saturation curve-aligned coordinates 404, which are used by the Spline Function Calculator 406 to compute a value for the third thermofluid property variable 407 and also values for the thermofluid property function derivatives 408. These are transformed back into the engineering units of the two input thermofluid property variables via the Derivative Coordinate Transformation 409, which uses the Auxiliary Thermofluid Property Vector 405 to produce the third thermofluid property variable derivatives in engineering units 410. The figure illustrates the steps taken for evaluating a thermofluid property function. A pair of input thermofluid property variables h and P 401 is input into the Fluid Property Coordinate Transformation T 402. This changes the coordinates to saturation curve-aligned variables ($\xi$, $\eta$) 404, and also computes a vector of Auxiliary Thermofluid Property Vector $\zeta$ 405. The pair of saturation curve-aligned variables ($\xi$, $\eta$) 404 are input to the Spline Function Calculator 406, which evaluates a two-dimensional B-spline, preferably using equations (6)-(7), in order to compute a third thermofluid property variable $\rho$. In addition, the Spline Function Calculator 406 computes derivatives 408 of $\rho$ with respect to the saturation curve-aligned variables ($\xi$, $\eta$), preferably using equation (8). Derivatives 408 are transformed back to the units of (h,P) 401 by the Derivative Coordinate Transformation 409, which makes use of Auxiliary Thermofluid Property Vector $\zeta$. Both the Fluid Property Coordinate Transformation T 402 and the Spline Function Calculator 406 make use of data vector $\delta$, which includes data (e.g. data 1703 in FIG. 17) stored in storage (e.g. storage 1702 in FIG. 17) loaded to computer memory (e.g. memory 1706 in FIG. 17) such as spline coefficients, knot points, and scaling factors. While this computation was expressed with the purpose of computing the third thermofluid property variable $\rho$, this should not be interpreted to limit this method to the computation of only this specific thermodynamic property variable, as the described method can be applied to many other thermofluid property variables such as temperature, specific entropy, specific internal energy, thermal conductivity, viscosity, etc. In some cases, the data may be refrigerant data including thermodynamic and transport properties and computer-executable programs including a B-spline method which can be referred to as a spline function calculator.

Figure 5:
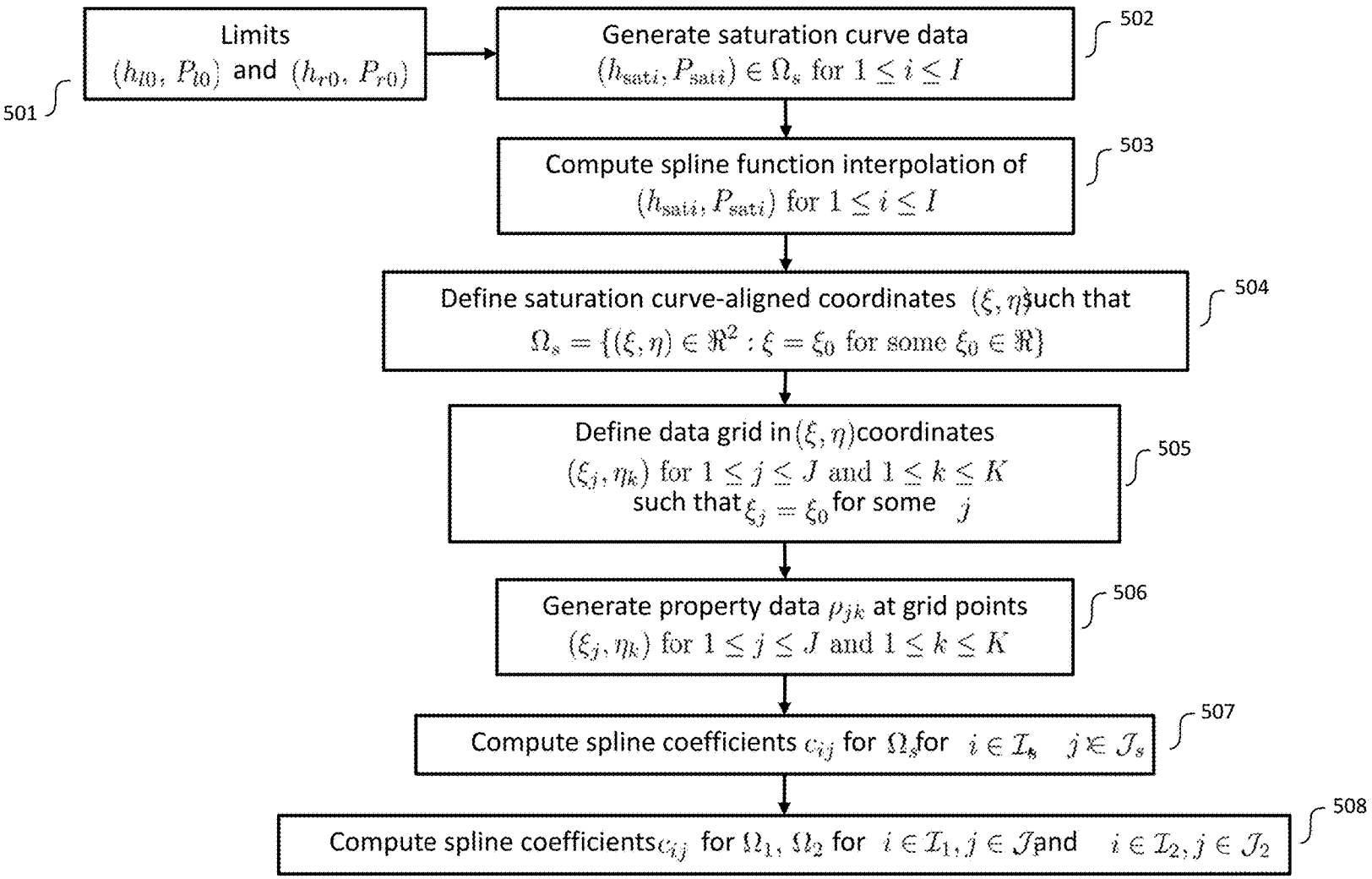
FIG. 5 shows a flow chart for one embodiment of the process to compute the thermofluid property function data on a digital computer, according to embodiments of the present invention.

FIG. 5 is a flow chart of the process for the constructing a fluid property function with saturation curve-aligned coordinates according to some embodiments of the present invention. This process requires a few inputs and tools to proceed, the first of which is the specification of a set of bounds 501 for the computation in the input fluid property variables. If the input thermofluid property variables specific enthalpy and pressure ($h_e$, $P_e$) are scaled in engineering units, this would specify minimum and maximum values of $h_e$ and $P_e$ for which the thermofluid property function is created. In addition, this process requires the use of a tool for calculating thermodynamic property reference data, referred to here as a Thermofluid Property Calculator tool. There are a number of such tools available for properties of refrigerants used in vapor compression cycles, such as REFPROP and CoolProp. Other fluid property calculation tools also exist, or the data may be available from measurements or other sources. These tools are typically computer algorithms realized in software that make use of iterative methods to compute solutions to sets of equations that represent the mathematics of thermodynamics, fluid mechanics, fluid dynamics, etc. Occasionally these iterative methods may not converge, and as a result sometimes return an error rather than the thermodynamic property data at a pair of input thermofluid property variables. However, they work well for the majority of such points, and can be used effectively to produce reference data from which a thermofluid property function can be constructed. The methods described herein have the benefit of easily accommodating such missing data, so that the resulting thermofluid property function is largely unaffected by the absence of a small number of data due to errors in the Thermofluid Property Calculator tool.

As shown in FIG. 5, the first step in generating a thermofluid property function involves using the Thermofluid Property Calculator tool to obtain data for the desired properties on the liquid and vapor saturation curves 502 for a set of points i for $1 \le i \le I$. This curve is one-dimensional, and the obtained data for the thermofluid property variable ρ is a function of a single property variable. Pressure P, or the logarithm of P, is often used for the independent fluid property variable in this case. The value of ρ along both the liquid and vapor saturation curves may thus be obtained from a chosen minimum pressure up to the critical pressure of the fluid. These liquid and vapor saturation curves meet at the critical point, so that there is a single curve that traverses a path from low pressures and low specific enthalpies along the liquid saturation curve along higher pressures up to the critical point, after which the pressure decreases along the vapor saturation curve until the minimum pressure is again reached.

In the second step, a saturation curve interpolating function 503 is computed which describes the saturation curve as a function of an implicit parameter $u_i$ for $0 \le u_i \le 1$. Standard methods to create this interpolating function that represents the saturation curve may be used. The saturation curve is thus defined as two coordinates, such as h and P, that are a function of a single parameter u. This parameter u is typically set to 0 at the low pressure limit on the liquid saturation curve, and to 1 at the low pressure limit on the vapor saturation curve. This parameterized representation is important because it can smoothly interpolate between points on the saturation curve at which data is missing.

In the third step, a coordinate transformation to a pair of saturation curve-aligned variables (ξ, η) 504 is defined such that the saturation curve represents a level set in the (ξ, η) coordinate system. This coordinate transformation has the effect of aligning the saturation curve with the coordinate system, so that ξ is constant along the saturation curve. The use of this transformation is based upon the realization that numerical errors that occur when computing thermofluid property variables in the vicinity of the liquid or vapor saturation curves are caused by the curvature of the saturation curve in a coordinate system of interest, and that aligning the coordinate system of the interpolation with the saturation curve will eliminate the cause of these errors. The use of this transformation is further based on the realization that, in the (ξ, η)-coordinates, B-splines may be used to represent a fluid property variable of interest, with knots of multiplicity l=p (where p is the degree of the spline) placed on the saturation curve. This allows for the accurate, efficient and consistent calculation of derivatives of a fluid property variable near the saturation curve in the (ξ, η) coordinates.

In the fourth step, a grid is defined in the saturation curve-aligned coordinates (ξ, η) 505 and fluid property data is computed from the Thermofluid Property Calculator tool on that grid. Thus, a set of sample points $\xi_j$ for $1 \le j \le J$ and $\eta_k$ for $1 \le k \le K$ that will be used to sample the thermofluid property variable of interest are specified. Different approaches for selecting these samples may be used. This may include a uniform sampling of points over a minimum and maximum value of the coordinate, or the selection of a nonuniform sampling density to manage the interpolation error over the range of thermofluid property function.

In the fifth step, the Thermofluid Property Calculator tool is used to compute reference data for the desired thermofluid property variable ρ 506 at reference locations in the saturation curve-aligned coordinate system. For example, the Thermofluid Property Calculator tool computes the density $\rho_{jk}$ for each value of the tuple $(\xi_j, \eta_k)$ where $1 \le j \le J$ and $1 \le k \le K$ and there are J samples of the ξ coordinate and K samples of the η coordinate. The output of this step is a set of data for ρ on a saturation curve-aligned grid.

In the sixth step, spline coefficients $c_{ij}$ for the thermofluid property function are calculated for the saturation curve in these saturation curve-aligned coordinates 507. An advantage of this spline coefficient calculation process is that it can be accomplished using least-squares methods, which are straightforward to implement in common computational tools.

In the seventh step, coefficients of the B-spline representation of the thermofluid property function, $c_{ij}$, are calculated for the in the regions of the domain not on the saturation curve, $\Omega_1$ and $\Omega_2$ 508. The discontinuity in derivative of the thermofluid property function on saturation curve is represented by knots on the spline curve in the ξ-direction having multiplicity p, where p is the degree of the spline function. The output of this step, and of this overall process, are a set of pre-computed coefficients and a discontinuity-capturing representation of the thermofluid property function that can be used to calculate a third thermofluid property variable, and derivatives of a third thermofluid property variable, from a pair of two input thermofluid property variables in the domain of interest as in FIG. 3.

Figure 6:
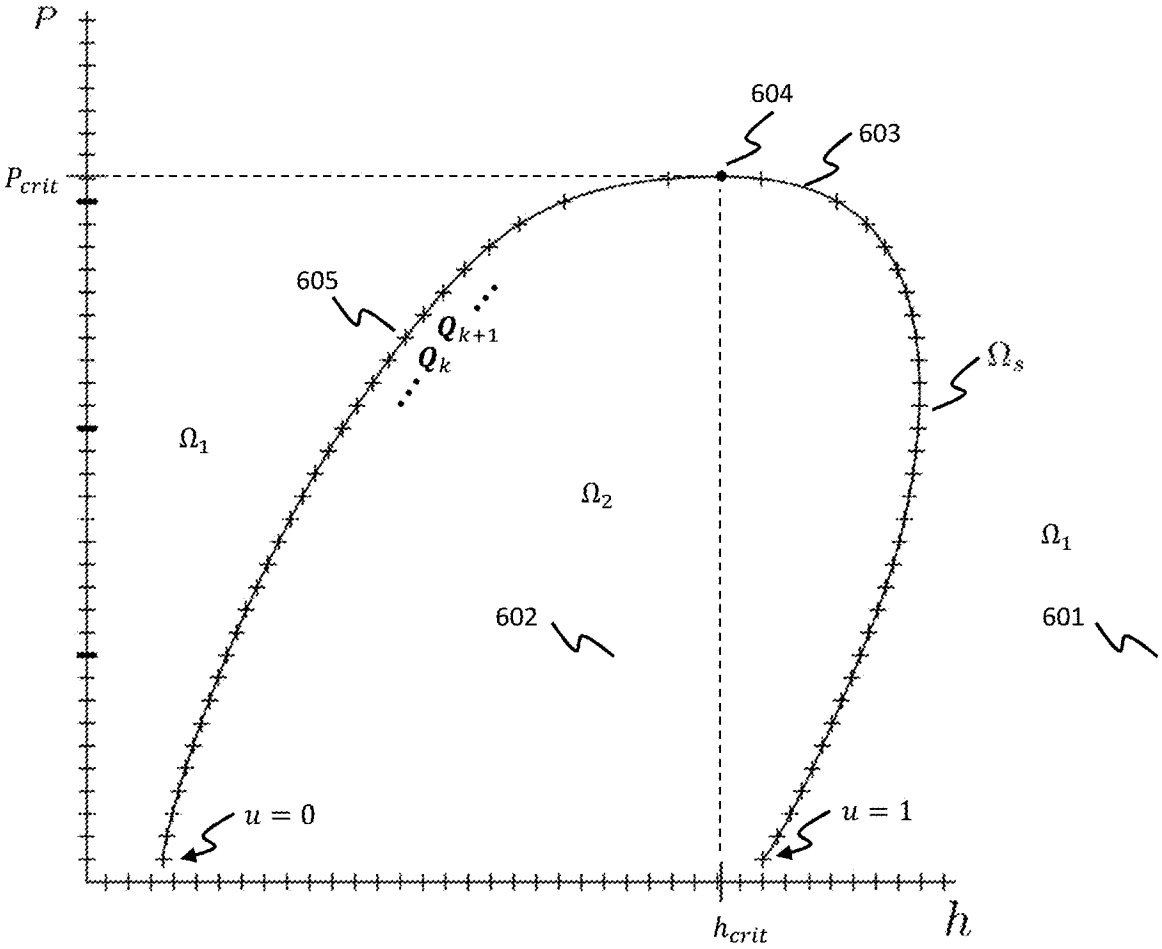
FIG. 6 shows a plot of saturation curve as a function of input thermofluid property variables specific enthalpy h and pressure P, with the saturation curve dividing the region of interest into the two-phase region and the single-phase region, showing the critical point, sampled data long the saturation curve, and the interpolating function that represents the saturation curve, according to embodiments of the present invention.

FIG. 6 shows a plot of saturation curve as a function of input thermofluid property variables specific enthalpy h and pressure P, with the saturation curve that is configured to divide the region of interest into the two-phase region 601 and the single-phase region 602, showing the critical point 604, sampled data long the saturation curve 605, and the interpolating function that represents the saturation curve 603.

The figure illustrates an exemplar saturation curve which is fit to data obtained from the Thermofluid Property Calculator tool, and which is represented by a parameterized variable u. In general, a pure fluid, such as water or a refrigerant like R32, can be described as consisting of two regions: a single-phase region $\Omega_1$ 601, which comprises the liquid region, the vapor region, and the supercritical region, and a two-phase region $\Omega_2$ 602. The saturation curve 603, which is a one-dimensional curve embedded in a two-dimensional space, represents the boundary between these regions characterizing the inception of a boiling or condensing process as state of a fluid volume in thermodynamic equilibrium moves from $\Omega_1$ to $\Omega_2$. The liquid and vapor saturation curves meet at the critical point 604, which represents the upper limit of pressure where two-phase behavior exists. Above this critical point, fluid exists in a homogeneous-single phase state, called the supercritical state.

Points $Q_k=(P_{sat,k}, h_{sat,k})$ 605 on this saturation curve can be calculated by many available Thermofluid Property Calculator tools via the use of iterative algorithms that seek to satisfy fundamental thermodynamic constraints for any thermofluid property variable of interest. While these Thermofluid Property Calculators prefer the use of iterative algorithms because they can be motivated by the underlying physics, their implementation on digital computers sometimes results in nonconvergence so that data cannot be obtained for arbitrary points on the saturation curve. In order to robustly interpolate between these missing points, the saturation curve is described as the image of a parameterized function $(h,P)=f(u)$, where $u=0$ at the low pressure limit on the liquid saturation curve, and $u=1$ for the low pressure limit on the vapor saturation curve. The value of u corresponding to a given (h,P) pair must be identified iteratively in this formulation, but methods for building lookup tables that provide practical acceleration for this lookup process are readily available in the literature.

Cartesian Coordinate Transformation

Figure 7:
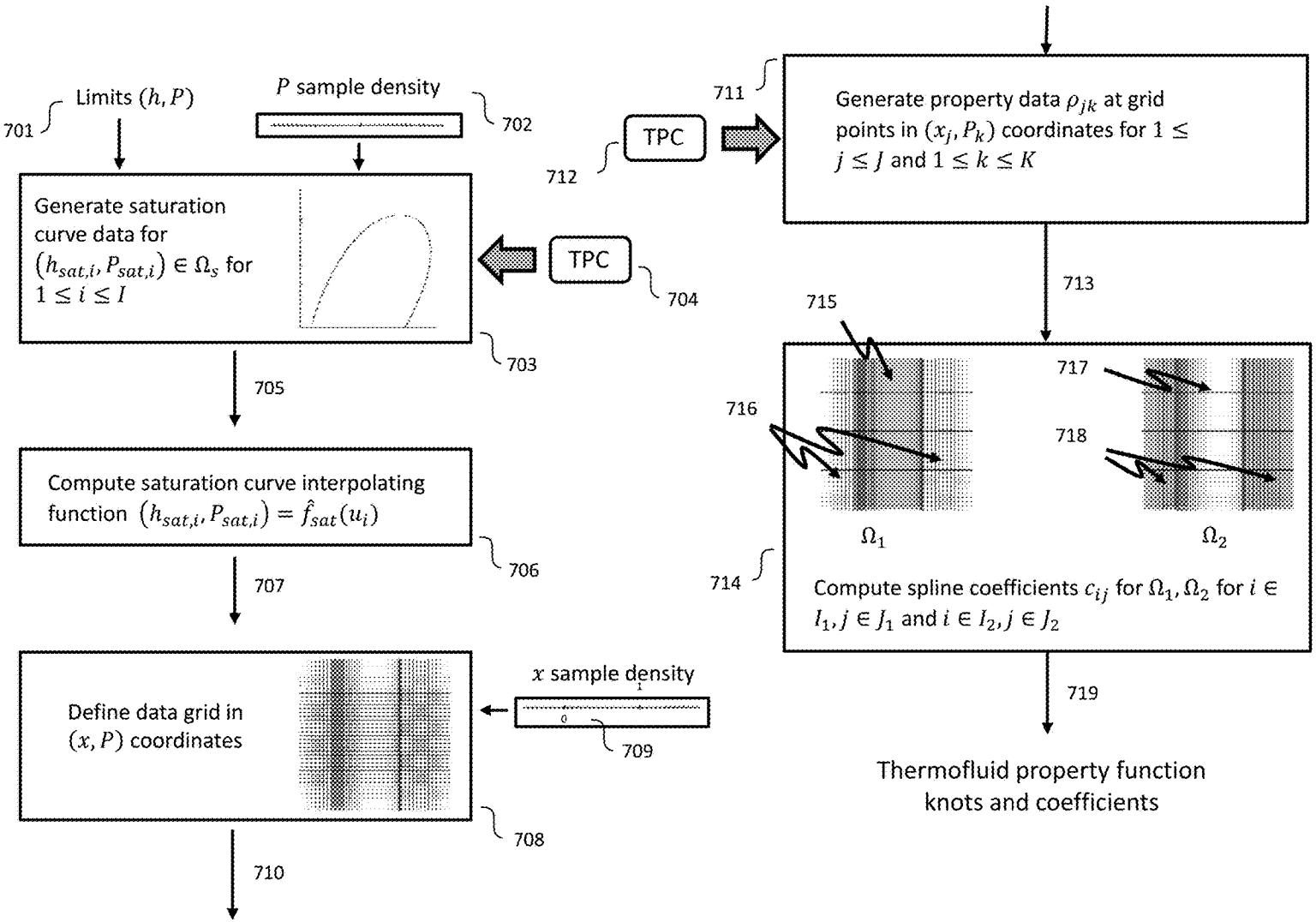
FIG. 7 shows a block diagram of the construction of the fluid property function calculation using the methods of saturation curve-aligned coordinates, according to embodiments of the present invention.

FIG. 7 shows a block diagram of the construction of one embodiment of the fluid property function calculation using the methods of saturation curve-aligned coordinates that makes use of the quality thermofluid variable x as the saturation-curve aligned coordinate. Given limits of the first and second input thermofluid variables over the range of interest 701 and a sampling density for pressure 702, reference data on the saturation curve is calculated from a Thermofluid Property Calculator 704. Knots and coefficients for a B-spline function that represents the saturation curve 705 are then computed. The samples of the data grid in the saturation curve-aligned coordinates are then computed 708, and the Thermofluid Property Calculator 712 is then used to calculate thermofluid property data for the third thermofluid property variable at this grid of points 711. This coefficients of the two-dimensional B-spline representing the thermofluid property function are then computed 719. The figures illustrates the construction of the thermofluid property function for the Cartesian Coordinate Transform embodiment. This embodiment uses a Fluid Property Coordinate Transformation from the input pair of thermofluid property variables (h,P) to the pair of saturation-curve aligned variables $(\xi, \eta)=(x,P)$, where p is the pressure and x is the thermodynamic quality, defined as $$x = \frac{h - h_{liq}(P)}{h_{vap}(P) - h_{liq}(P)}. \tag{11}$$

This aligns the liquid saturation curve with the value $x=0$, while the vapor saturation curve is aligned with the value $x=1$. In this embodiment, the saturation curve-aligned coordinate $\xi=x$, which splits into two separate sets. This coordinate transformation used in this embodiment is only valid up to the critical pressure of the fluid, though additional aspects will be described that enable this to be extended to pressures above the critical pressure. This embodiment is useful in many practical circumstances because of the ubiquity of subcritical vapor compression cycles in air-conditioning, heat pumps, refrigerators, and energy recovery applications.

The process of computing the thermodynamic property functions begins with a pair of upper and lower limits on h and P 701, as well as a desired uniformly or non-uniformly sampled set of pressures P 702 at which the data will be obtained. For example, a user may specify that the pressure is sampled every 10 kPa from the low pressure limit to the maximum pressure limit (below the critical pressure).

With this data, the Thermofluid Property Calculator 704 (denoted in this diagram as TPC) is used to generate the data along the saturation curve 703 for a thermofluid property variable of interest along the saturation curve $\Omega_s$. Most Thermofluid Property Calculator tools, such as REFPROP, provide an explicit means for calculating this information as a function of one variable, such as the pressure. The resulting data 705 is provided to the next block 706, which calculates the coefficients of the saturation curve interpolating function $\hat{f}_{sat}(u)$. As described in FIG. 6, the coefficients of an implicit B-spline based representation of the thermofluid property function that describes the smooth saturation curves is) calculated from the samples of data $(h_k, P_k, \rho_k, \ldots)$ to provide $(h, P, \rho, \ldots)=\hat{f}_{sat}(u)$ for $0\leq u\leq 1$. These spline coefficients can be calculated with standard approaches for solving linear systems, with appropriate modifications and regularizations as are required to address scaling and other numerical concerns. As before, one principal advantage of the use of B-splines is that derivatives of this saturation curve can be easily calculated from original calculated spline coefficients and the analytic derivatives of the spline basis functions. The resulting coefficients of the saturation curve interpolation function 707 are then passed to the next stage of the thermodynamic property function generation process.

Next, a data grid is generated 708 at which samples of the thermofluid property variable will be calculated by the Thermofluid Property Calculator tool. While the pressure samples 702 may be used at this step, a grid of samples 709 in the saturation curve-aligned coordinate, such as the thermodynamic quality x, must be specified. For example, a uniform spacing of x where values are separated by 0.01, may define the grid. Alternatively, a nonuniform spacing for the values of may be used. The values of $x=0$ and $x=1$ must also be included in this grid to ensure the correct representation of the locations at which the derivative discontinuities occur. Because the transformation between x and h is nonlinear and depends on P, the pressure-dependent upper and lower limits of x must then be calculated from the saturation curve interpolation function. The output of this step 710 is thus a vector of thermofluid property variables $x_j$ of length J and vector of pressures $P_k$ of length K at which data on the thermodynamic property of interest will be obtained from the Thermofluid Property Calculator tool.

The output 710 of the grid generation block 708 can be then used to generate the reference data on the grid points 711 in the transformed coordinate domain of p and x by using the Thermofluid Property Calculator tool. Because the grid is defined in the saturation curve-aligned coordinates (x,P), but the inputs for the Thermofluid Property Calculator tool are in the units of the input pair of thermofluid variables (h,P), the saturation curve interpolation function $\hat{f}_{sat}(u)$ is used to calculate the inputs for the Thermofluid Property Calculation tool from the saturation curve-aligned coordinates (x,P) for every point on the data grid $(x_j, P_k)$ for $1\leq j\leq J$ and $1\leq k\leq K$, i.e., $$(h_j,P_k)=(x_j h_{vap}(P_k)+(1-x_j)h_{liq}(P_k),P_k) \tag{12}$$

This produces data for the third thermofluid property variable $\rho_{jk}$ at a Cartesian set of points in the (x,P) plane 713 which are aligned with the saturation curves.

The final step in this embodiment 714 calculates the coefficients of the thermofluid property function $c_{ij}$ over the single-phase region $\Omega_1$ and two-phase region $\Omega_2$ from the data 713 obtained from the previous step. This calculation is ensures that the derivative discontinuities associated with the saturation curve are reproduced at the correct location via the insight that knots of multiplicity l=p (where p is the degree of the spline) may be included in a B-spline basis function to locate changes in continuity of the derivative at specific points. By locating a knot of multiplicity l=p exactly on the saturation curve at x=0 and x=1, the resulting B-spline realization of a thermofluid property function possesses derivative discontinuities on the saturation curve while maintaining sufficient smoothness at all other points in the domain. These knot vectors, corresponding to the saturation curve-aligned coordinate axes, are then used to calculate the remaining coefficients $c_{ij}$ of the thermofluid property function. This calculation can be posed as solving a sequence of least squares problems for the control points of the B-splines first in one direction, and then the second direction. Methods described in subsequent embodiments can be used to perform this calculation. Because the numerical conditioning of this computation can sometimes be poor, Tikhonov regularization can be used to improve the performance of this fit by adding a small diagonal term to improve the condition number of the data matrix. After the conclusion of this fitting process, the output 719 includes all of the information used by the thermofluid property function, including the knot vectors and a set of coefficients that describe the observed data. These values and coefficients are then stored in computer memory.

Figure 8:
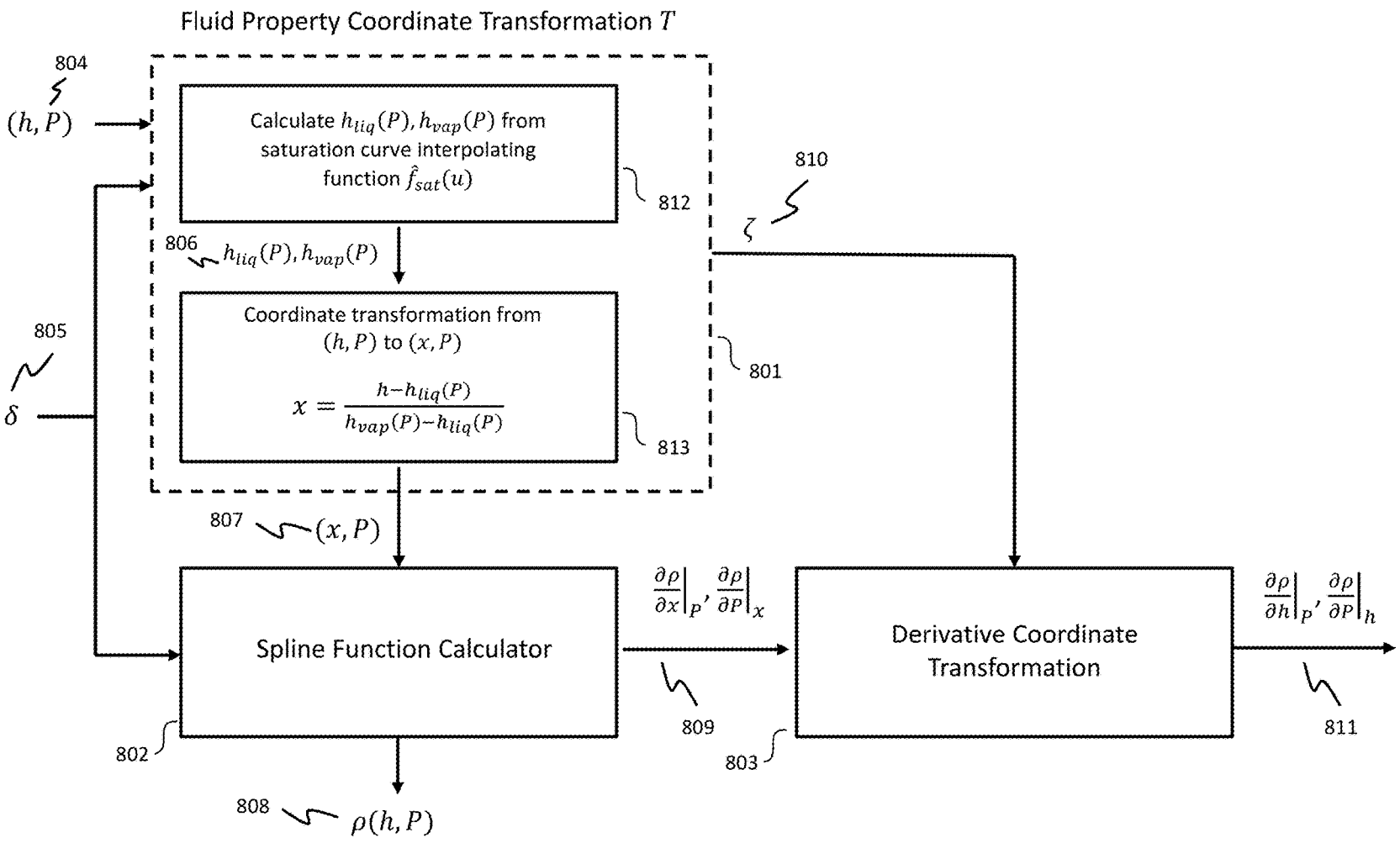
FIG. 8 shows a block diagram describing the thermofluid property function calculation using the methods of saturation curve-aligned coordinates, according to embodiments of the present invention.

FIG. 8 shows a block diagram of one embodiment of the thermofluid property function calculation using the methods of saturation curve-aligned coordinates, that makes use of the thermofluid property variable quality x as the saturation-curve aligned coordinate. Fluid Property Coordinate Transformation T 801 acts on the two input thermofluid property variables 804 and data 805 to produce independent thermodynamic variables (ξ, η) in the saturation curve-aligned coordinates 806, which are used by the Spline Function Calculator 802 to compute a value for the third thermofluid property variable 808 and also values for the thermofluid property function derivatives 904. These are transformed back into the engineering units of the input thermofluid property variables via the Derivative Coordinate Transformation 803, which uses the Auxiliary Thermofluid Property Vector 810 to produce the thermofluid property variable derivatives in engineering units 811. The figure illustrates the evaluation of a thermofluid property function in the Cartesian Coordinate Transformation embodiment. The embodiment consists of three parts: a Fluid Property Coordinate Transformation T 801, a Spline Function Calculator 802, and a Derivative Coordinate Transformation 803. The input to these blocks are a set of input fluid property variables 804, such as (h,P), and the set of precomputed coefficients and knot points that are stored in computer memory 805. The first step is to compute values of the specific enthalpy on the liquid saturation curve $h_{liq}(P)$ and the vapor saturation curve $h_{vap}(P)$ 812 from the saturation curve interpolating function $\hat{f}_{sat}(u)$ These are used for the calculation of the saturation curve-aligning coordinate transformation 813, denoted as (x,P) in this embodiment. The transformation from h to x is accomplished by using the inverse of the equation described in FIG. 7, i.e., $$x = \frac{h - h_{liq}(P)}{h_{vap}(P) - h_{liq}(P)}. \tag{13}$$

This step returns the specific values (x,P) 807 at which the B-spline function in the Spline Function Calculator 802 is to be evaluated. The Spline Function Calculator 802 computes the value of $\hat{\rho}(P,x)$ in the saturation curve-aligned coordinates, as a function of the spline coefficients and knots stored in the data δ 805.

When using a thermofluid property function, the user may seek to obtain either a property variable or one of its derivatives. While the thermofluid property variable can be obtained through a straightforward evaluation of the thermofluid property function, the change in the coordinate system imposes additional computational needs for derivative computations due to the fact that the derivatives are with respect to the transformed coordinate system, rather than the natural coordinate system. When using these saturation curve-aligned coordinates, the available derivatives for property ρ for this embodiment are $d\rho/dP|_x$ and $d\rho/dx|_P$, rather than $d\rho/dP|_h$ and $d\rho/dh|_P$, as desired. A Derivative Coordinate Transformation 803 must therefore be used to transform the derivatives from the interpolating coordinate system into the engineering coordinate system; in the case of density, such transformations are given by the Jacobian of T, $$\frac{d\rho}{dP}\Big|_h = \left(\frac{d\rho}{dP}\Big|_x - \frac{1}{(h_g - h_f)}\frac{d\rho}{dx}\Big|_P\left[\frac{dh_f}{dP} + x\left(\frac{dh_g}{dP} - \frac{dh_f}{dP}\right)\right]\right), \tag{14}$$

$$\frac{d\rho}{dh}\Big|_P = \frac{1}{(h_g - h_f)}\frac{d\rho}{dx}\Big|_P. \tag{15}$$

These transformations require information about the properties on the saturation curves and their derivatives, so additional information in the Auxiliary Thermofluid Property Vector ζ 810 is needed from the Property Coordinate Transformation 801 to complete this calculation. After these transformations, the thermofluid property variable derivatives 811 with respect to the input fluid property variables (h,P) are produced as an output. The outputs of these calculations, being either properties or their derivatives, can then be used by a controller or optimizer to adapt the system behavior.

While this embodiment provides a means of computing thermofluid property variables in the subcritical region using a coordinate transformation that aligns the saturation curve with the coordinate axes in order to correctly represent the derivative discontinuities at the saturation curve, it has not addressed the subject of characterizing thermofluid property variables or thermofluid property functions in the vicinity of the critical point or in the supercritical region. This can be accomplished by using methods that are similar to those described above and combining them via blending functions.

Figure 9:
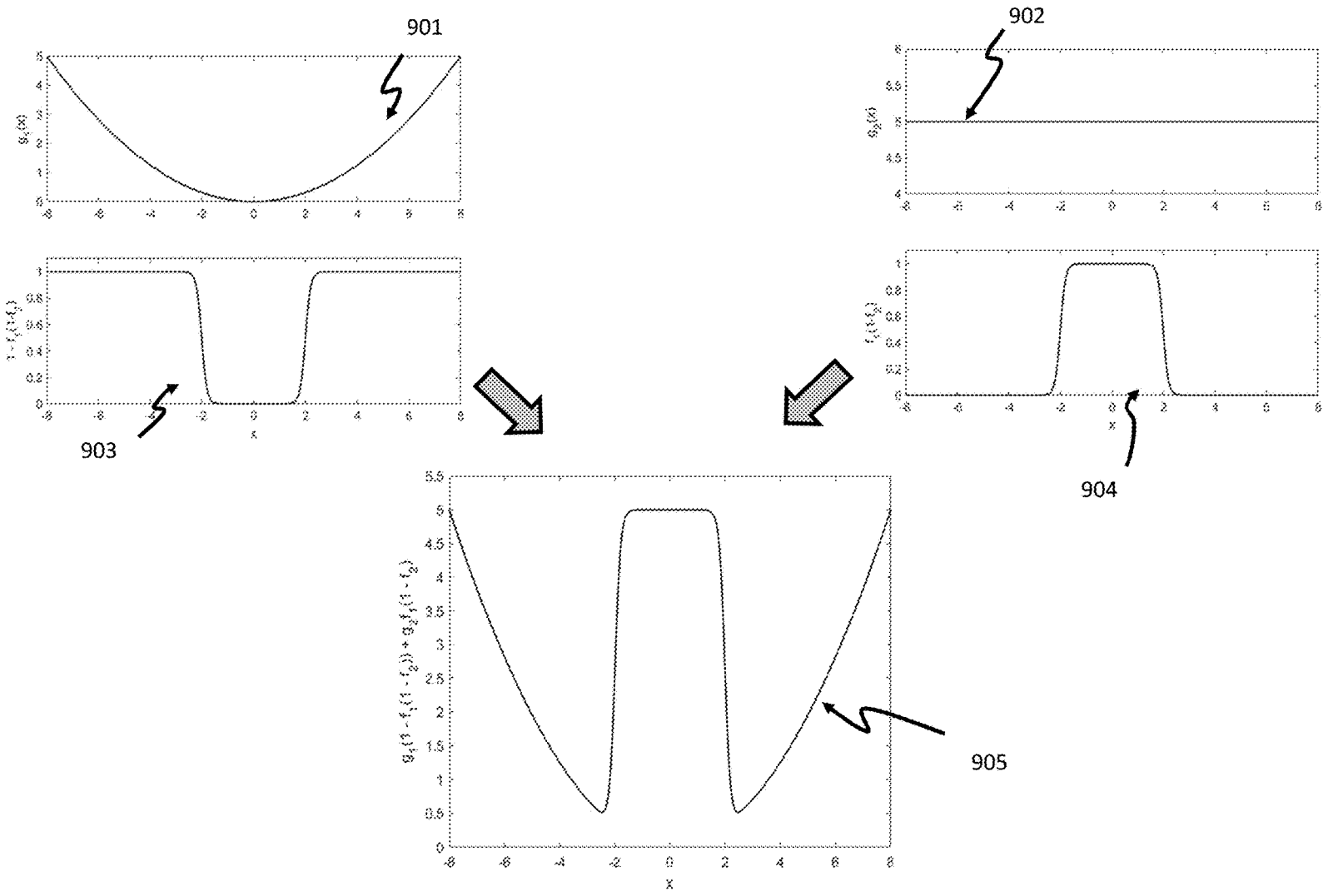
FIG. 9 shows a diagram illustrating the use of blending functions and for combining multiple model functions, according to embodiments of the present invention.

FIG. 9 shows a diagram illustrating the use of blending functions 903 and 904 for combining multiple model functions 901 and 902 that are individually valid only over smaller subdomains to create a complete model 905 that is valid over the union of those subdomains. The figure illustrates the use of blending functions for combining multiple functions that are individually only valid over smaller subdomains. One example of a useful blending function is the logistic function, given by $$f(x) = \frac{1}{1 + e^{-k(x - x_0)}} \tag{16}$$

This blending function f(x) and the complementary blending function 1−f(x) can be used to combine functions because this function smoothly varies between 1 and 0, with the transition between these values centered at $x_0$ and the slope of the transition between these values proportional to k. This function is useful because it can be used to easily select subdomains, and because it is differentiable. There is a transition band between the selected domain and the nonselected domain of a width controlled by k, which is typically located in a region where both functions to be blended accurately represent the composite function. Because it is difficult to succinctly visualize the process of blending thermodynamic functions together, this figure illustrates an examplar 1-D scenario in which function $g_1(x)=(5/64)x^2$ 901 is valid for $x<-2$ and $x\geq 2$, while function $g_2(x)=5$ 902 is valid for $-2<x<2$. Two related blending functions are used for this process, where $$f_1(x) = \frac{1}{1+e^{-10(x+2)}} \tag{17}$$

and $$f_2(x) = \frac{1}{1+e^{-10(x-2)}}. \tag{18}$$

The function $g_1(x)$, shown in the upper left plot, is multiplied by the blending function $1-f_1(x)(1-f_2(x))$ 903, which preferentially selects the domain less than −2 and greater than 2, while the function $g_2(x)$ shown in the upper right plot, is multiplied by the complementary blending function $f_1(x)(1-f_2(x))$ 904. The result of the direct sum of these products 905 can be seen in the plot in the middle of this figure, which clearly shows that the regions of interest for these two disparate functions have been blended together.

A directly analogous approach can be used to blend together multiple thermofluid property functions, each defined on different but overlapping domains. For example, three overlapping domains can be defined to cover a large domain of interest on the (h,P)-plane, ranging from the subcritical to supercritical regions: a first subcritical domain, which does not extend up to the critical pressure; a second supercritical domain, which extends down into the subcritical region slightly, but which uses a simple approximation of the behavior around the critical point; and a third critical domain, which covers only the region immediately surrounding the critical point. Thermofluid property functions for each domain may be constructed as described in this embodiment, and a value of $\hat{p}(h,P)$ for each domain can be calculated as described in this embodiment. If the pair (h,P) of input thermofluid variables lie in an intersection of these three overlapping domains, then the thermofluid property variables computed from each domain may be blended together to calculate an output thermofluid property variable. This output thermofluid property variable will vary smoothly between the subdomains of validity due to the differentiability of the blending function.

While a means of constructing and evaluating a thermofluid property function in the subcritical region of the (h,P)-plane have been described in this embodiment, similar methods may be used to construct thermofluid property functions in the supercritical region and around the critical point. Use of interpolating functions in the supercritical region is straightforward and can be directly extended from existing method for fitting B-splines, due to the lack of discontinuities in this region. Methods similar to the embodiment discussed above can be used to create multiple versions of a thermofluid property function in the vicinity of the critical point, but a different coordinate transformation must be used in this area due to the existence of a singularity in x at the critical point. One such coordinate transformation takes the engineering coordinates (h,P) to an alternate set of saturation curve-aligned coordinates (h,y), where y is defined as $$y = \frac{P - P_{min}}{P_{sat}(h) - P_{min}} \tag{19}$$

for an appropriately chosen value of $P_{min}<P_{crit}$. This transformation also aligns the coordinate system with the saturation curve, though the alignment is with the y-axis, rather than the x-axis.

Normalized Polar Coordinates

A second embodiment of the invention defines a Fluid Property Coordinate Transformation from a pair of input fluid property variables to a pair of saturation curve-aligned variables (ξ, η) using a normalized polar coordinate transformation. B-Splines are used in the normalized polar coordinates to represent an approximation to the fluid property function. This embodiment has an advantage that it covers a domain that includes both sub- and super-critical regions of a fluid state.

Coordinate Transformations

Consider a fluid property such as density ρ (kg/m$^3$), as a function of input fluid property variables pressure $P_e$(Pa) and specific enthalpy $h_e$, (kJ/kg) where the subscript e denotes that the variables are in engineering units. Fluid density is used to illustrate the embodiment, but it should be understood that P may represent any other fluid property variable. Pressure and specific enthalpy are used as input fluid property variables to illustrate the embodiment and for clarity of exposition, but it should be understood that these may be any other input fluid property variables.

Consider a domain of interest Ω on the $h_e$–$P_e$ plane, on which an approximation of a fluid property function ρ, denoted $\hat{\rho}(h_e, P_e)$, is constructed. Ω may include the two-phase region and also the liquid and vapor regions, and the super-critical region above the critical point. In this embodiment, a Fluid Property Coordinate Transformation is the composition of three coordinate transformations, but in other embodiments that use different input fluid property variables, for example, there may be less than three. Each of the three coordinate transformations is described below.

Scaling Coordinate Transformation

Choose an origin $(h_{e0}, P_{e0})\in\Omega$ where $h_{e0}$ is a specific enthalpy in engineering units (kJ/kg) and $P_{e0}$ is a pressure in engineering units (Pa). The origin is typically near the center of Ω and inside the two-phase region. Choose values for two scaling factors, $P_s$ (Pa) and $h_s$ (kJ/kg), to define the scaling coordinate transformation as $T_1:R^2\rightarrow R^2:(h_e, P_e)\mapsto(h,p)$ as $$h=(h_e-k_{e0})/h_s \tag{20}$$

$$p=(\log(P_e)-\log(P_{e0}))/P_s. \tag{21}$$

The scaling factors are chosen such that the dimensionless p and h are O(1) over Ω. Denote the origin in the (h,P) coordinates as $(h_0, p_0)$. The inverse scaling coordinate transformation, $T_1^{-1}:R^2\rightarrow R^2:(h,p)\mapsto(h_e, P_e)$, is $$h_e=h_s\cdot h+h_{e0} \tag{22}$$

$$P_e=\exp(P_s\cdot p+\log(P_{e0})). \tag{23}$$

In some embodiments that make use of other input fluid property variables, $T_1$ may be defined differently, in order to scale the variables to be O(1) over $\Omega$, as is well known to those skilled in the art. In some embodiments, the two input fluid property variables are O(1) over $\Omega$, so that scaling is not needed. In this case, $T_1$ may be the 2×2 identity matrix.

Polar Coordinate Transformation

In the scaled (h,p) coordinates, define a polar coordinate transformation $T_2:R^2 \rightarrow R_2:(p,h) \mapsto (r,\theta)$ as $$r=\sqrt{h^2+p^2} \tag{24}$$

$$\theta=\text{atan}(p,h), \tag{25}$$

where atan(•,•) is the two-argument, four quadrant inverse tangent function. The inverse polar coordinate transformation $T_2^{-1}:R^2 \rightarrow R^2:(r,\theta) \mapsto (h,p)$ is $$h=r\cdot\cos(\theta) \tag{26}$$

$$p=r\cdot\sin(\theta). \tag{27}$$

Saturation Curve Radial Distance Normalization

Figure 10:
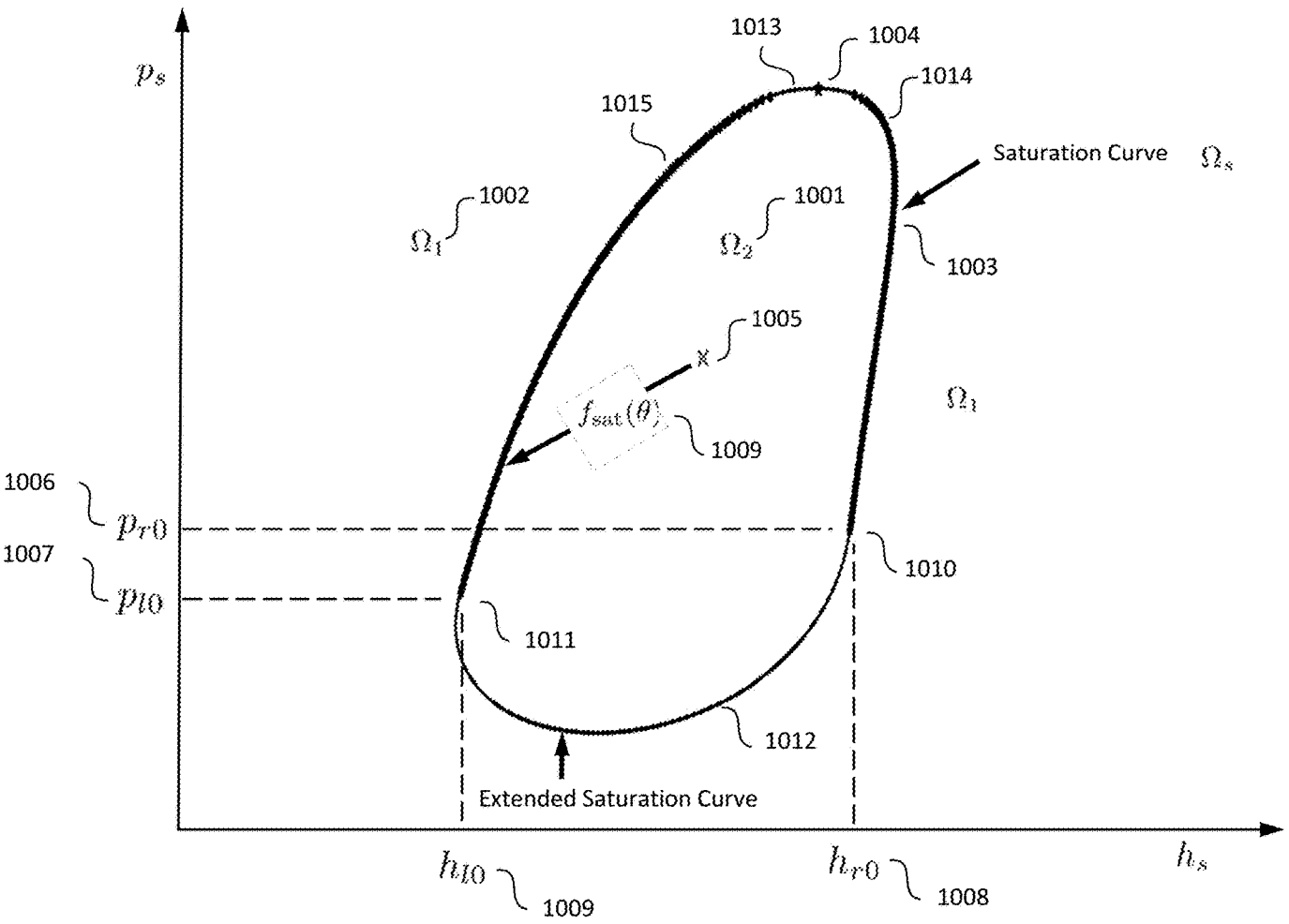
FIG. 10 shows a diagram of the saturation curve for refrigerant R410A on the Cartesian plane defined by scaled independent thermofluid property variables (h,p), according to embodiments of the present invention.

FIG. 10 shows a diagram of the saturation curve 1003 for refrigerant R410A on the Cartesian plane defined by scaled independent thermofluid property variables (h,P), showing the single phase region 1002, the two phase region 1001, the origin of the polar coordinates 1005, the critical point 1004, the minimum scaled pressure 1006 (right) and 1007 (left), respectively, the extended saturation curve 1008, and the radial distance to saturation curve function $f_{sat}(\theta)$, 1009. The figure illustrates a domain $\Omega$ on the (h,p)-plane, divided into three regions: $\Omega_2$ 1001 is the two-phase region; $\Omega_1$ 1002 is outside the two phase region, and may include the liquid, vapor or super-critical regions; and $\Omega_s$ 1003 is the saturation curve, which is the boundary between $\Omega_1$ and $\Omega_2$. Define $p_{r0}$ 1006 to be a small value of p on the vapor side of the saturation curve $\Omega_s$ at or near the lower boundary of $\Omega$. For some embodiments, $p_{r0}<0$ since the origin in the (p,h)-coordinates 1005 is located near the center of $\Omega$. Consider a small value $p_{l0}$ 1007 of p on the liquid side of the saturation curve, at or near the lower boundary of $\Omega$. A precise value for $p_{l0}$ will be computed from $p_{r0}$ and the choice of spline knots in the $\theta$-direction below. Define $h_{r0}$ 1008 and $h_{l0}$ 1009 to be the scaled enthalpies corresponding to $p_{r0}$ and $p_{l0}$, respectively, on the saturation curve 1003. This defines the points $(h_{r0},p_{r0})$ 1010 and $(h_{l0}, p_{l0})$ 1011 on the saturation curve. Express these points in polar coordinates as $$(r_1,\theta_1)=T_2(h_{r0},p_{r0}) \tag{28}$$

and $$(r_{j*},\theta_j^*)=T_2(h_{l0},p_{l0}). \tag{29}$$

($j^*$ is defined below.) Then the saturation curve between $(h_{r0}, p_{r0})$ 1010 and $(h_{l0}, p_{l0})$ 1011, including the critical point $(h_c, p_c)$ 1004, may be represented on the (h,p) plane in polar coordinates as the image of a function 1009 $f_{sat}$: $R \rightarrow R:\theta \mapsto r$ $$r_{sat}=f_{sat}(\theta) \text{ for } \theta\in[\theta_1,\theta_{j*}]. \tag{30}$$

The saturation curve $\Omega_s$ 1003 in scaled coordinates (h,p) is then the image of $(h_{sat}, p_{sat})=T_2^{-1}(r_{sat},\theta)$ In this embodiment, functions are periodic in $\theta$, but $f_{sat}$ has been defined in equation (30) for only the closed interval $\theta\in[\theta_1, \theta_{j*}]$. As shown in FIG. 10, choose an extension of $f_{sat}$ 1012 on the open interval $(\theta_{j*}, \theta_1+2\pi)$ so that the extended $f_{sat}$ is periodic in $\theta$ and $C^p$ (continuous up to $p^{th}$ derivative) for all $\theta\in R$, for some value of p>0. (A value for p is defined below as the degree of a spline.) Essentially, this defines a closed curve (a loop) to be the image of the extended $f_{sat}$ that is the saturation curve for scaled pressures larger than $p_{r0}$ and $p_{l0}$, and connects $(h_{l0}, p_{l0})$ 1010 and $(h_{r0},p_{r0})$ 1011 through the two-phase region, assuming that the saturation curve itself is $C^p$ as a function of $\theta$, as shown in FIG. 10.

In this embodiment, $f_{sat}(\theta)$ 1009 is approximated by an interpolating, periodic B-spline $\hat{f}_{sat}$ that is fit through data for r on the saturation curve $\Omega_s$ that is generated by a thermofluid property calculator such as REFPROP or CoolProp, or other form of data. But it should be understood that other functional representation, such as NURBS or Fourier series that may be constructed to fit this data are other embodiments of this invention.

A number $N_1$ of pairs of values of (h,p) 1014 are computed using a Thermofluid Property Calculator (304, 1705) and the transformations $T_1$ along the liquid side of the saturation curve from $(h_{r0}, p_{r0})$ 1010 up to but not including the critical point $(h_c, p_c)$ 1004. A number $N_2$ of pairs of values of (h,p) 1015 are computed using a Thermofluid Property Calculator and the transformations $T_1$ along the vapor side of the saturation curve from $(h_{l0}, p_{l0})$ 1011 up to but not including the critical point $(h_c, p_c)$ 1004. For many fluids the values of pressure and specific enthalpy on the saturation curve near the critical point is difficult to compute and may be inaccurate, but the value of pressure and specific enthalpy at the critical point may be computed precisely. Therefore, a small gap between data points may appear around the left side 1013 and right side 1014 of the critical point 1004. However, values for pressures below this gap may be precisely computed using REFPROP, CoolProp or an equivalent thermofluid property calculator. Add the calculated value of $(h_c, p_c)$ 1004 to the set of data from the vapor and liquid saturation curves, giving $N=N_1+N_2+1$ data pairs. This set is transformed into polar coordinates using $T_2$ giving a set of data points $(r_i,\theta_i)$ for $1\leq i\leq N$ defining the radial distance $r_i$ from the origin 1005 to the saturation curve $\Omega_s$ 1003 at discrete values of $\theta_i$.

Figure 12:
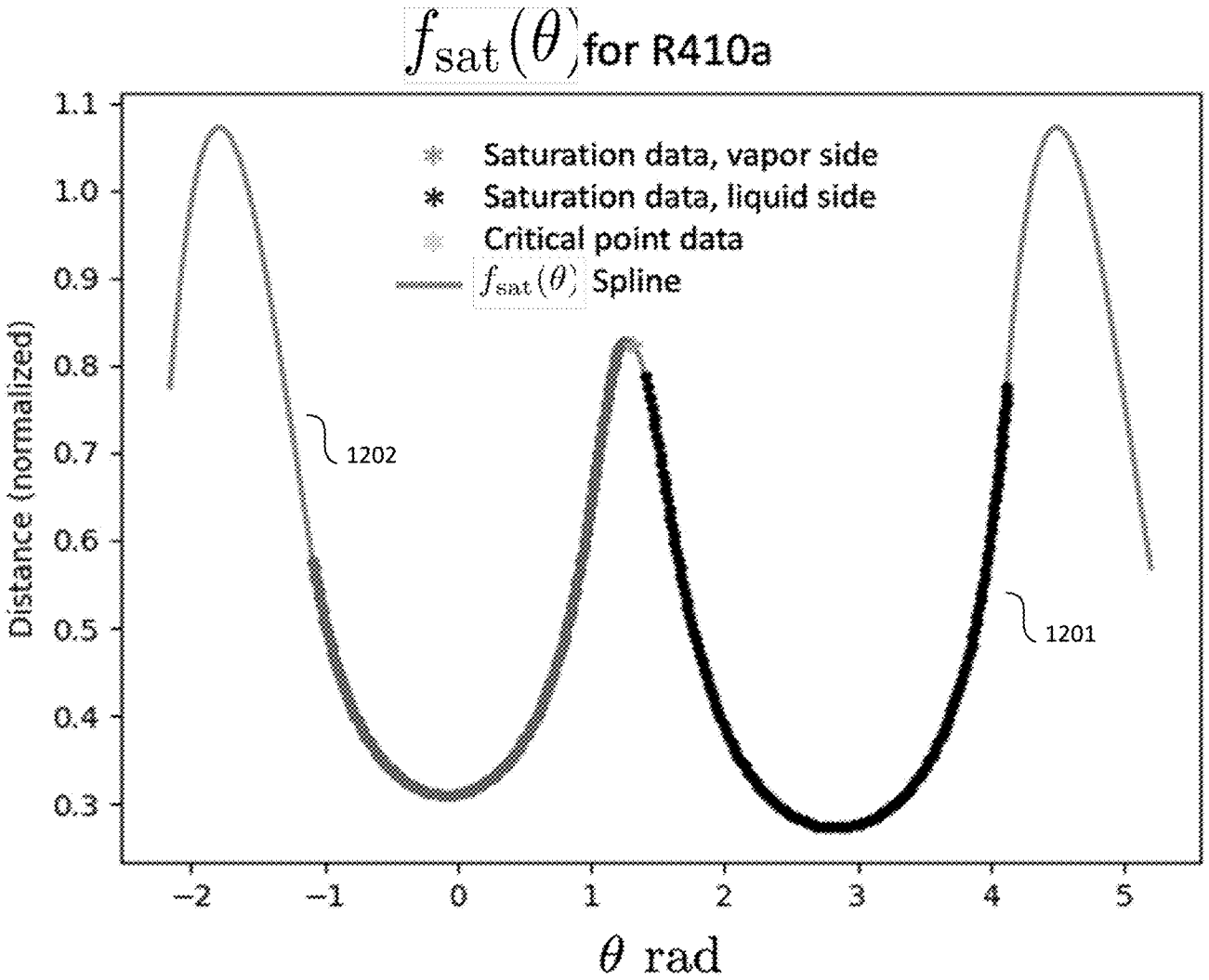
FIG. 12 shows a graph indicating the radial distance to saturation curve function $\hat{f}_{sat}(\theta)$, and data generated by the Thermofluid Property Calculator, used to fit $\hat{f}_{sat}(\theta)$, for R410A, according to embodiments of the present invention.

FIG. 12 shows a graph indicating the radial distance to saturation curve function $\hat{f}_{sat}(\theta)$, and data generated by the Thermofluid Property Calculator 1201, used to fit $\hat{f}_{sat}(\theta)$, for R410A, according to an embodiment of the present invention. In this embodiment, a periodic spline $\hat{f}_{sat}$ of degree $p=^3$ (cubic) is fit through the radial data $r_i$ as a function of $\theta$, as shown in FIG. 12, where the data $r_i$ 1201 is interpolated by the spline function 1202. Cubic periodic splines are preferred since the spline will pass through all the data points, and the number of data points N equals the number of spline coefficients N, so the latter may be computed from the former by matrix inversion that is known to those skilled in the art. This also defines the extended saturation curve 1012 in FIG. 10. Note that in this embodiment, the knots $\theta_i$ are all of multiplicity 1, and may not be uniformly spaced.

This embodiment of $\hat{f}_{sat}(\theta)$ can be expressed mathematically as $$\hat{f}_{sat}(\theta)=\sum_{i=1}^{N} c_{si}N_{i,3}(\theta) \tag{31}$$

where $N_{i,3}^n(\theta)$ are 3-degree B-spline basis functions that depend on knots $\theta_i$, and $c_{si}$ are coefficients, $1\leq i\leq N$. In this embodiment, $\hat{f}_{sat}(\theta)$ is computed algorithmically for a value $\theta$ using the computationally efficient, recursive formulae including equations (6)-(7), modified slightly for periodic basis functions, that take as input a value of $\theta$, the knots $\theta_i$ and the coefficients $c_{si}$, $1\leq i\leq N$, and compute a value for $\hat{f}_{sat}$, and which are known to those skilled in the art [4, 7].

A third coordinate transformation $T_3:R^2 \rightarrow R^2:(r,\theta) \longmapsto (\bar{r}, \bar{\theta})$ normalizes the distance between the origin and saturation curve to a constant value of one, and is defined as $$\bar{r}=r/\hat{f}_{sat}(\theta) \tag{32}$$

$$\bar{\theta}=\theta, \tag{33}$$

with inverse $T_3^{-1}:R^2 \rightarrow R^2:(\bar{r},\bar{\theta}) \longmapsto (r,\theta)$ $$r=\bar{r}\cdot\hat{f}_{sat}(\bar{\theta}) \tag{34}$$

$$\theta=\bar{\theta}. \tag{35}$$

In this embodiment, the distance from origin to saturation curve is normalized to one, but it should be understood that other embodiments may normalize the distance to any other constant value. In this embodiment, the saturation curve-aligned variables $(\xi, \eta)$ are $\xi=\bar{r}$ and $\eta=\bar{\theta}$, with the saturation curve being represented as $\xi=\bar{r}=1$, including the extended saturation curve.

Figure 13:
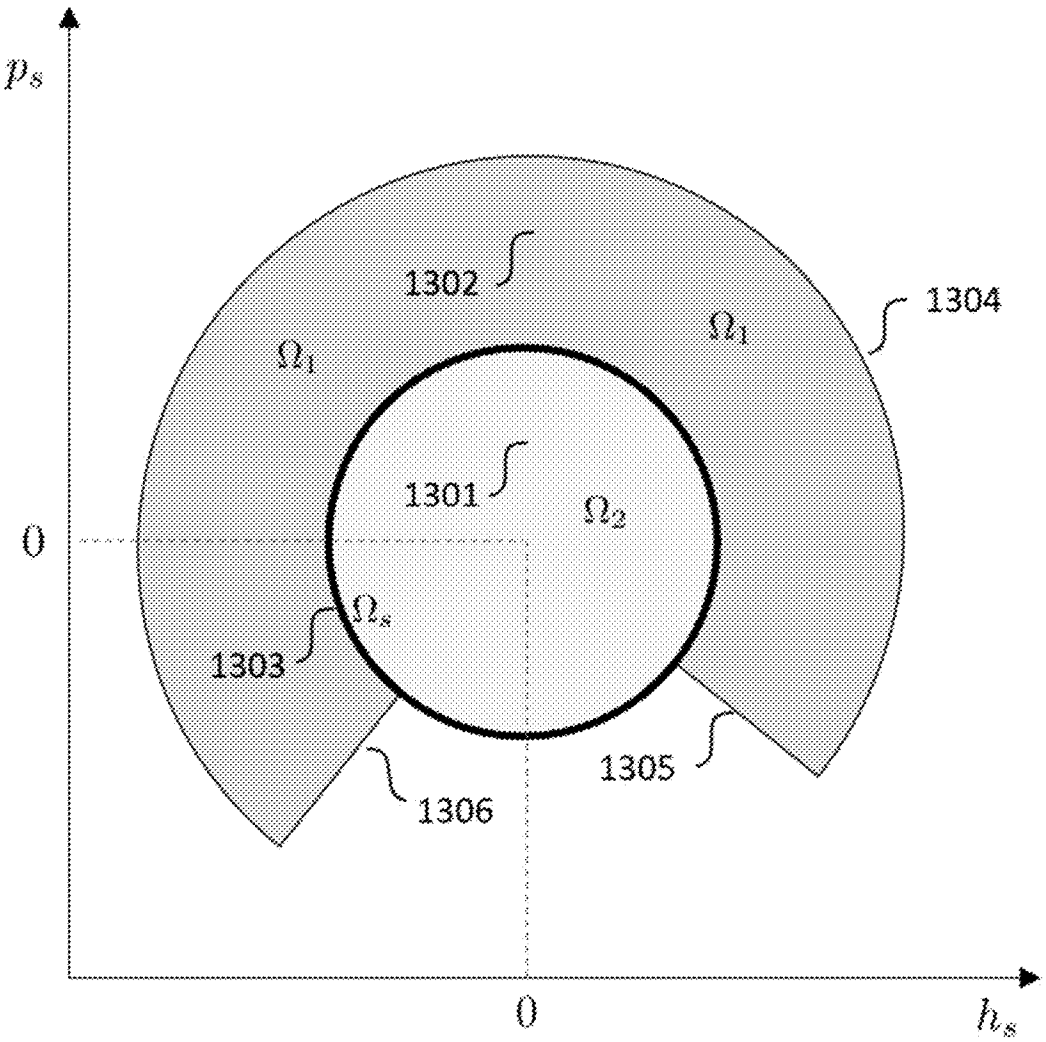
FIG. 13 shows the region of interest $\Omega$ in the saturation curve-aligned coordinates $(\xi, \eta)=(\bar{r},\bar{\theta})$ for the normalized polar coordinates, according to embodiments of the present invention.

FIG. 13 shows the region of interest $\Omega$ in the saturation curve-aligned coordinates $(\xi,\eta)=(\bar{r},\bar{\theta})$ for the normalized polar coordinates according to an embodiment of the present invention. The figure shows the two-phase region 1301, the single phase region 1302, the saturation curve including the saturation curve extension 1303, which is the unit circle, the boundary of the region of interest in the radial direction 1304, and the boundaries of the region of interest in the $\bar{\theta}$-direction on the left 1306 and right 1305, respectively. The figure indicates $\rho$ in the $(\bar{r},\bar{\theta})$ coordinates, with 1301 being the two phase region $\Omega_2$, 1302 being the region $\Omega_1$, 1303 being the saturation curve at unit radial distance from the origin, 1304 being the maximum radius of $\Omega$.

Polar Splines

The fluid property function $\rho$ is approximated by a two-dimensional spline function $\hat{\rho}$ of degree p defined in the $(\bar{r},\bar{\theta})$-coordinates. Spline functions in dimensions higher than one are conventionally constructed for Cartesian coordinates, and the presence of the origin where conventional polar coordinates exhibit a singularity requires some special considerations, especially when evaluating derivatives. In the following, knots in the $\bar{r}$ and $\bar{\theta}$ directions are first defined. Uniform knots are more computationally efficient than non-uniform knots, and are therefore used in this embodiment, but it should be understood that non-uniform knots are another embodiment of the same invention. Then basis functions are constructed in a manner that a resulting spline function has the desired continuity characteristics on the saturation curve. This is done by requiring some of the knot points on the saturation curve to have a multiplicity equal to the spline basis degree p.

Knot Points

Figure 11:
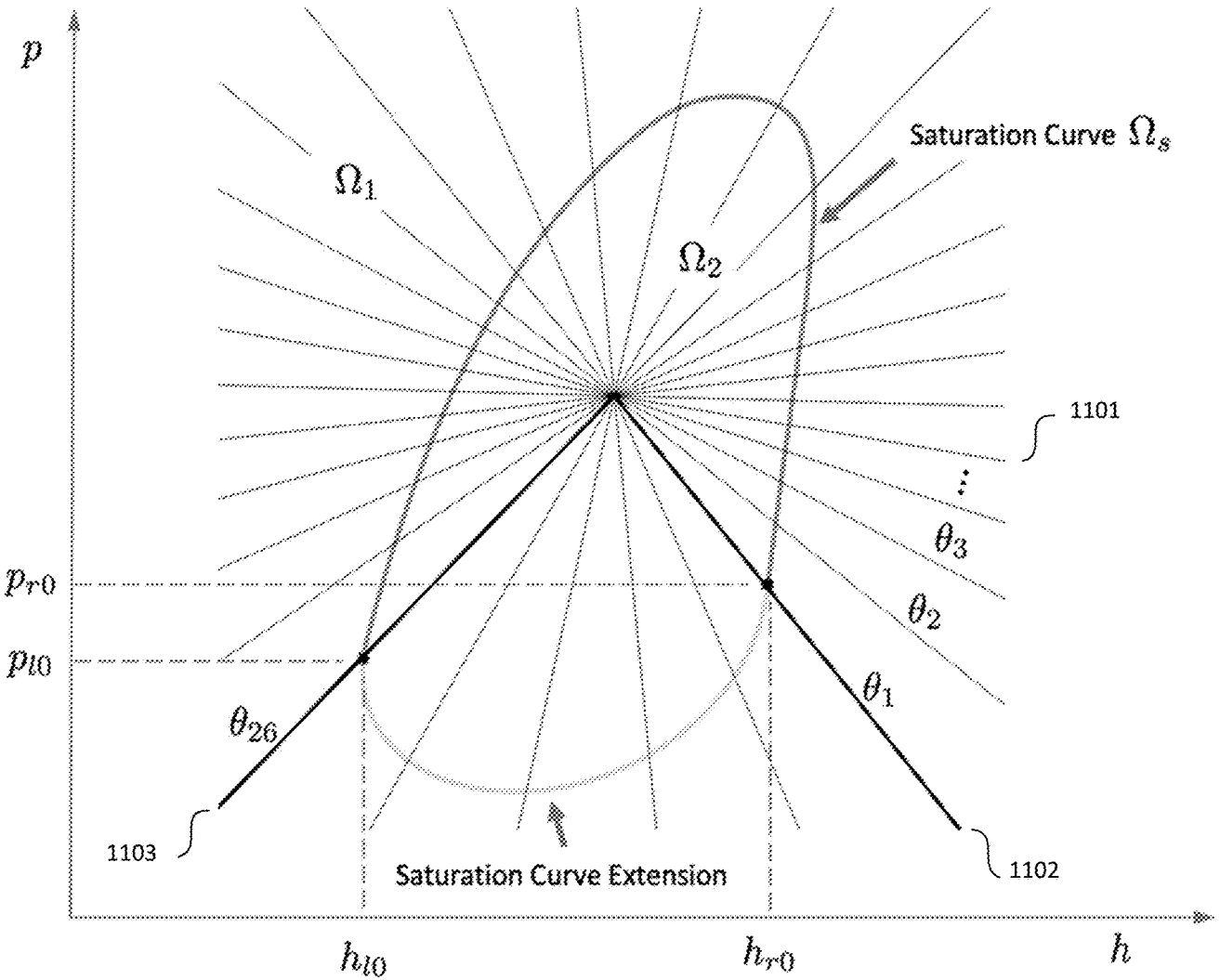
FIG. 11 shows a diagram showing the closed saturation curve, including saturation curve extension, with knots in the $\bar{\theta}$-direction, showing the values of $\bar{\theta}$ corresponding to the minimum scaled pressure on the right and left 1, respectively, according to embodiments of the present invention.

FIG. 11 shows a diagram showing the closed saturation curve, including saturation curve extension, with knots in the $\bar{\theta}$-direction 1101, showing the values of $\bar{\theta}$ corresponding to the minimum scaled pressure on the right 1102 and left 1103, respectively.

Referring to FIG. 11, the first knot point in the $\bar{\theta}$ direction, denoted 1102, is chosen coincident with the point $(h_{ro},p_{ro})$ on the vapor side of the saturation curve, and knots 1101 are spaced uniformly in a counter-clockwise (positive) direction. One of the knots $\theta_{j*}$ 1103 is coincident with $(h_{lo}, p_{lo})$ on the liquid side of the saturation curve. This knot defines the index j* and defines the point $(h_{lo}, p_{lo})$ in this embodiment. Therefore, this step proceeds the construction of $\hat{f}_{sat}$ described earlier.

In the $\bar{r}$-direction, knots are defined for both positive and negative values of $\bar{r}$ in order to compute B-spline coefficients for $\hat{\rho}$. The negative values of $\bar{r}$ are needed in order to compute B-spline coefficients near the origin. Denote the maximum value of $\bar{r}$ in the domain of interest $\Omega$ as $\bar{r}_{max}$. Then in the $\bar{r}$-direction, a number of knots is spaced uniformly from $-\bar{r}_{max}$ to $\bar{r}_{max}$, such that 0, 1 and −1 are included in the knot set. The knots −1 and 1 correspond to the saturation curve in the normalized polar coordinates.

Basis Functions

Once knots are defined in the $\bar{r}$ and $\bar{\theta}$ variables, B-spline basis functions are defined as follows, so as to represent the behavior along the saturation curve to be continuous, but not continuously differentiable in the $\bar{r}$-direction. In this embodiment, p=3 (cubic) splines are preferred, because they allow for the first and second order derivatives to be computed at all points in the domain $\Omega$ except for derivatives with respect to $\bar{r}$ on the saturation curve. However, other embodiments of this invention may use a different spline degree, or even splines whose degree might vary knot-to-knot.

In the $\bar{r}$-direction, B-spline basis functions are defined for $-\bar{r}_{max} \leq \bar{r} \leq \bar{r}_{max}$, with knots of multiplicity p at 1 and −1 (at the saturation curve), knots of multiplicity p+1 at $-\bar{r}_{max}$ and $\bar{r}_{max}$, and knots of multiplicity 1 spread uniformly at other points between $-\bar{r}_{max}$ and $\bar{r}^{max}$, including the origin, so that any spline function constructed from this basis (any linear combination of the B-spline basis functions) is $C^p$ between any of the knots, $C^{p-1}$ at any of the knots not on the saturation curve, and $C^0$ at 1 and −1, on the saturation curve.

Figure 14:
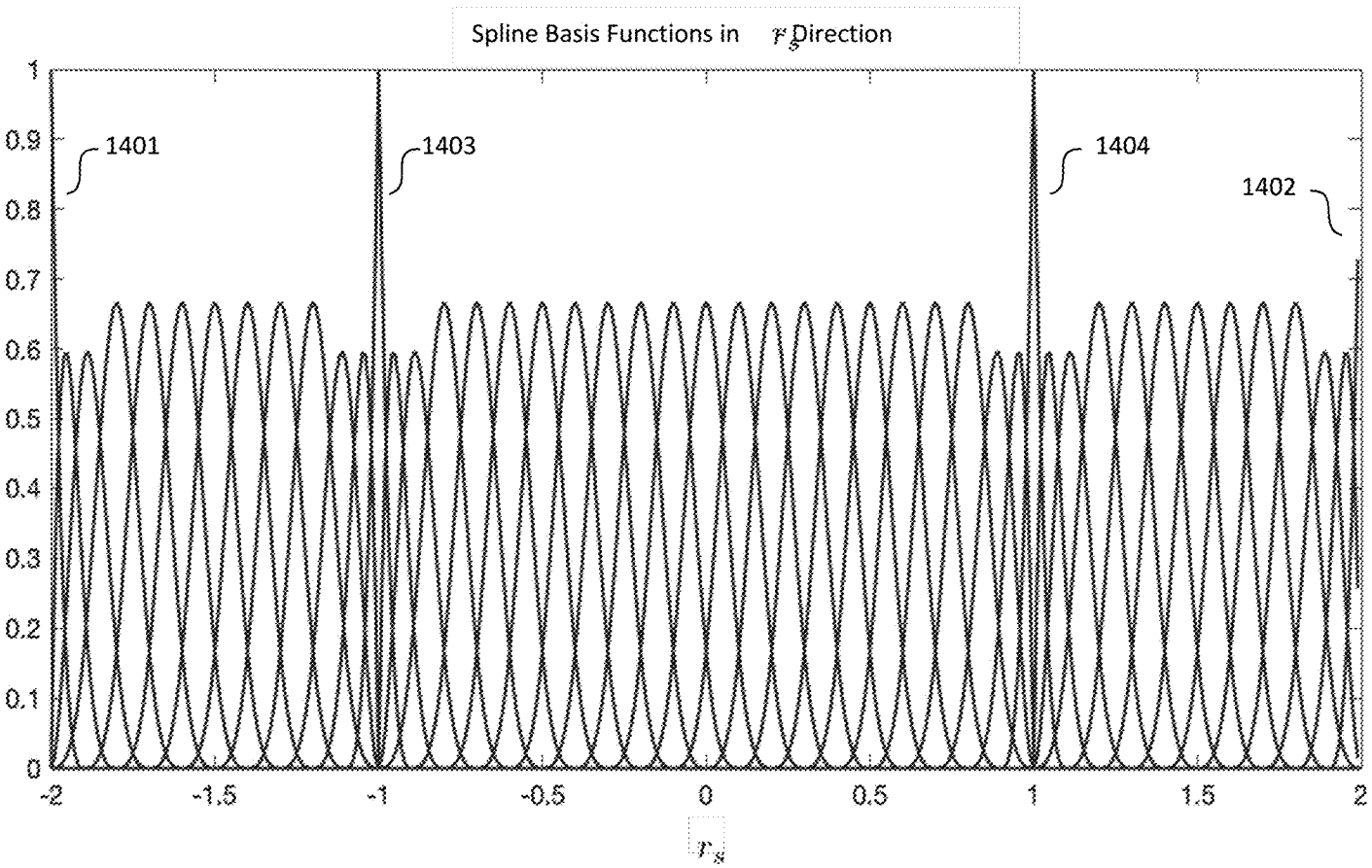
FIG. 14 shows the spline basis functions in the radial direction for the normalized polar coordinates, according to embodiments of the present invention.

FIG. 14 shows the spline basis functions in the radial direction for the normalized polar coordinates according to some embodiments of the present invention. The figure shows knots of multiplicity 3 on the saturation curve 1403 for $\bar{r}=-1$ and 1404 for $\bar{r}=1$, and the limits of the region of interest 1401 for $\bar{r}_{min}=-2$ and 1402 for $\bar{r}_{max}=2$. The figure illustrates a plot of a set of B-spline basis functions for p=3, $\bar{r}_{max}=2$ and knots spaced uniformly with a pitch of 0.1. The B-spline basis functions at the interval ends 1401 and 1402, respectively, are due to the multiplicity of p+1=4 at $-\bar{r}_{max}$ and $-\bar{r}_{max}$, respectively. The B-spline basis functions centered at −1 1403 and 1 1404 are centered on the saturation curve and ensure that any resulting B-spline function is continuous but not necessarily continuously differentiable as a function of $\bar{r}$ at those points. Note that each point in the open interval $(-r_{max}, r_{max})$, more than one B-spline basis function is nonzero except at −1 and 1, where only the B-spline basis functions 1403 or 1404 is identically one. This fact is critical for computing B-spline coefficients for $\hat{\rho}$, as will be shown.

Indexing of B-spline functions in polar coordinates is more complex than for Cartesian coordinates. For the $\bar{r}$-direction, denote the set of integers that index the spline basis as $$I=\{i \in I: 1 \leq i \leq i_{max}\}, \tag{36}$$

where $i_{max}$ is the number of spline basis functions. Let $i_{sn} \in I$ and $i_{sp} \in I$ denote the indices that correspond to $\bar{r}=-1$ and $\bar{r}=1$, respectively, i.e., the saturation curve in the $\bar{r}$-direction. Decompose I into $$I_s=\{i_{sn}, i_{sp}\}, \tag{37}$$

$$I_1=\{i \in I: i<i_{sn}\} \emptyset \{i \in I: i>i_{sp}\} \tag{38}$$

$$I_2=\{i \in I: i_{sn}<i<i_{sp}\}, \tag{39}$$

so that $I_s$ contains the basis indices in the $\bar{r}$-direction on the saturation curve (region $\Omega_s$), $I_1$ contains the basis indices in the $\bar{r}$-direction outside the saturation curve (region $\Omega_1$), and $I_2$ contains the basis indices in the $\bar{r}$-direction inside the saturation curve (region $\Omega_2$). Note that $I=I_1 \cup I_s \cup I_2$ and the intersections among $I_1$, $I_s$ and $I_2$ are empty.

Figure 15A:
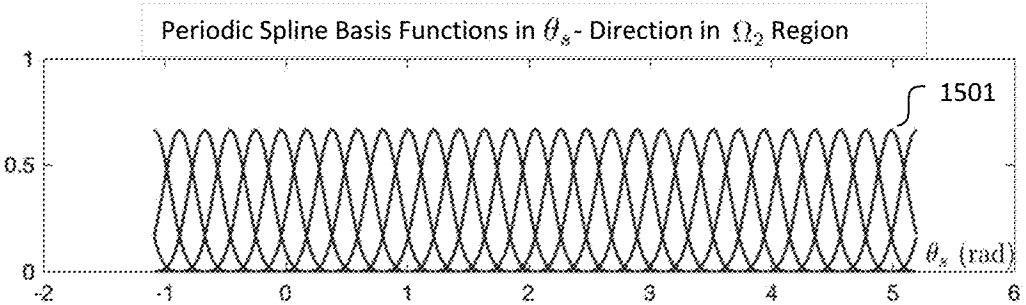
FIGS. 15A, 15B and 15C show the spline basis functions in the $\bar{\theta}$-direction for the normalized polar coordinates, according to embodiments of the present invention.
Figure 15B:
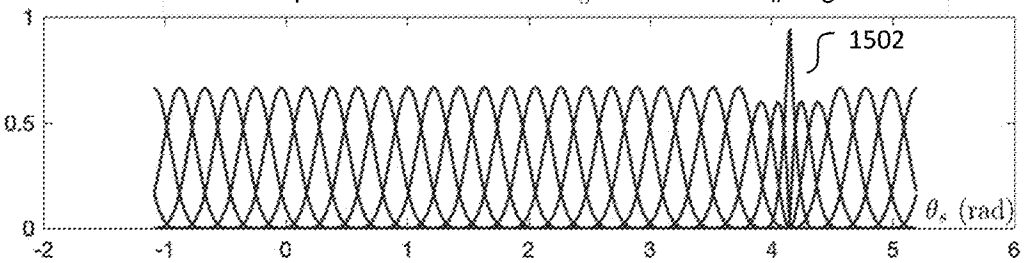
Figure 15C:
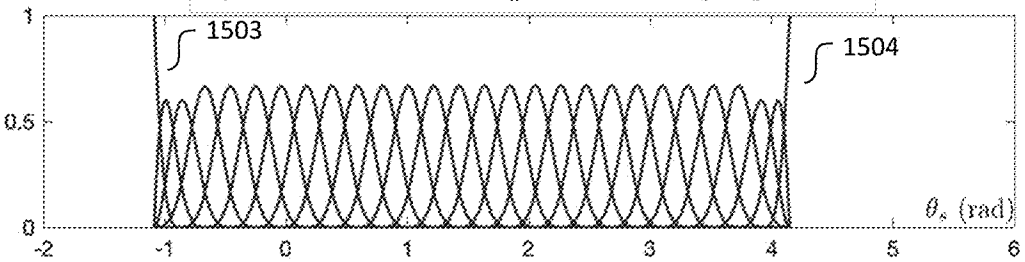

In the $\hat{\theta}$-direction, this embodiment has a different number of basis functions depending on the fluid state region, making the B-spline indexing dependent on the region. FIGS. 15A, 15B and 15C show the spline basis functions in the $\bar{\theta}$-direction for the normalized polar coordinates, according to embodiments of the present invention. The figures indicate the three different bases for the three different regions of interest corresponding to the two-phase region, saturation curve, and single-phase region. The spline basis functions in the two-phase region 1501 are periodic, while the spline basis functions for the saturation curve have a knot of multiplicity 3 1502 located at the minimum scaled pressure point on the left. The spline basis in the single-phase region is bounded at the minimum (h,p)-points on the left 1503 and right 1504.

In the two-phase region $\Omega_2$, the B-spline basis functions in the $\bar{\theta}$ direction 1501 are periodic, defined for all values of $\bar{\theta}$, and all of the knots are of multiplicity one. Denote the set of integers that index the spline basis in the $\bar{\theta}$-direction in region $\Omega_2$ as $$J=\{j\in I: 1\leq i\leq j_{max}\}. \tag{40}$$

On the saturation curve, the density $\rho$ is continuously differentiable as a function of $\theta$ except at the point $\theta_{j*}$ 1107, and possibly at the point $\theta_1$ 1106, where there is a transition between the actual saturation curve and the extended saturation curve. This embodiment assumes $\rho$ is continuously differentiable at $\bar{\theta}_1$, but in other embodiments, $\rho$ may be continuous but not differentiable at $\theta_1$, depending on the specifics of the fluid or fluid property. At $\bar{\theta}_{j*}$, the saturation curve is continuous, but not continuously differentiable, as a function of $\bar{\theta}$. Therefore, the B-spline basis functions need to be constructed for the region $\Omega_s$ so that they allow for non-smooth representation at $\theta_{j*}$. Just as in $\Omega_2$, the B-spline basis on $\Omega_s$ as a function of $\bar{\theta}$ is periodic. Therefore, the B-spline basis shown in each of FIGS. 15A-15C for $\Omega_s$, has a knot of multiplicity p=3 placed at $\bar{\theta}_{j*}$ 1502. This leads to a different number of B-spline basis functions for $\Omega_2$ compared to $\Omega_s$, requiring a different indexing for each region. The set of integers that index the B-spline basis in the $\bar{\theta}$-direction in region $\Omega_s$ is $$J_s=\{j\in I: 1\leq i\leq j_{max}+p-1\}. \tag{41}$$

There are p−1 more basis functions on $\Omega_s$ because the knot at knot at $\bar{\theta}_{j*}$ is of multiplicity p, where p is the spline basis degree.

As illustrated in FIG. 13, this embodiment represents $\hat{\rho}$ in the region $\Omega_1$ for the partial annular set $(1, r_{max}]\times[\bar{\theta}_1,\bar{\theta}_{j*}]$ 1302. For many thermofluid systems of interest, the fluid property $\rho$ for values of the two independent fluid property variables corresponding to the region below the saturation curve 1303, between the limits 1306 and $\theta_1$ 1305 is outside the region of interest, and is ignored in this embodiment. However, it should be understood that including this region is another embodiment of this invention.

Since the region $\Omega_1$ 1302 is only partially annular, the B-spline functions in the $\bar{\theta}$ direction are not periodic in $\bar{\theta}$. In this region, the B-splines are Cartesian. Referring to FIGS. 15A-15C, knots of order p+1 are located at the endpoints $\bar{\theta}_1$ and $\bar{\theta}_{j*}$, while uniform knots of multiplicity one are placed at the same values of $\bar{\theta}$ as they are for regions $\Omega_1$ and $\Omega_s$ 1101. Denote the set of integers that index the spline basis functions in the $\bar{\theta}$-direction in region $\Omega_1$ as $$J_1=\{j\in J: j\leq j^*\}\cup\{j\in J: j\geq j_{max}-p+1\}. \tag{42}$$

Normalized Polar Spline Functions

The normalized polar spline function $\hat{\rho}$ is expressed mathematically as $$\hat{\rho}(\bar{r},\bar{\theta}) = \underbrace{\sum_{i\in I_2}\sum_{j\in J} c_{ij}N_{i,p}(\bar{r})N_{j,p}(\bar{\theta})}_{\Omega_2} + \underbrace{\sum_{i\in I_s}\sum_{j\in J_s} c_{ij}N_{i,p}(\bar{r})N_{j,p}(\bar{\theta})}_{\Omega_s} + \underbrace{\sum_{i\in I_1}\sum_{j\in J_1} c_{ij}N_{i,p}(\bar{r})N_{j,p}(\bar{\theta})}_{\Omega_1} \tag{43}$$

where $N_{i,p}(\bar{r})$ and $N_{i,p}(\bar{\theta})$ are the p-degree B-spline basis functions defined above, and $c_{ij}$ are spline coefficients that are computed by a curve fit algorithm to data, described below. Note that the summations are segregated by region.

To compute values for the coefficients $c_{ij}$ in equation (43), this embodiment is based on the realization that for values of $(\bar{r},\bar{\theta})\in\Omega_s$, in other words, for $\bar{r}=1$ (or $\bar{r}=-1$), $$\hat{\rho}(\bar{r},\bar{\theta}) = \sum_{j\in J_s} c_{i_{sn}j}N_{j,p}(\bar{\theta}) = \sum_{j\in J_s} c_{i_{sp}j}N_{i,p}(\bar{\theta}). \tag{44}$$

This is because all of the B-spline basis functions in the $\bar{r}$-direction vanish on $\Omega_s$, except for 1403 and 1404, in FIG. 14, corresponding to index $i_{sn}$ and $i_{sp}$, respectively, which are identically 1 for $\bar{r}=-1$ and $\bar{r}=1$, respectively. This makes the contributions from the $\Omega_2$ and $\Omega_1$ terms in (43) to be zero for $(\bar{r},\bar{\theta})\in\Omega_s$.

In this embodiment, the coefficients $c_{ij}$ for the $\Omega_s$ term in equation (43) are computed first using equation (44). For each value of $\bar{\theta}_j$ from a data set $D_s=\{\bar{\theta}_j: 1\leq j\leq N_s\}$, where $N_s$ is any integer greater or equal to the number of coefficients in (44) and $\bar{\theta}_j$ suitable sample $\Omega_s$, $\rho_j$ is computed on the saturation curve using a thermofluid property calculator such as REFPROP, CoolProp, or other similar data source. Then equation (44) may be solved for a set of coefficients $c_{i_{sn}}=c_{i_{sp}}$ by solving an interpolation problem or least squares-type curve fit problem or similar curve fit problem using methods well known to those skilled in the art.

Once the coefficients $c_{ij}$ are computed for the saturation curve $\Omega_s$, then equation (43) decomposes into two decoupled equations $$\hat{\rho}(\bar{r},\bar{\theta}) - \underbrace{\sum_{i\in I_s}\sum_{j\in J_s} c_{ij}b_i^n(\bar{r})b_j^n(\bar{\theta})}_{\Omega_s} = \underbrace{\sum_{i\in I_2}\sum_{j\in J} c_{ij}b_i^n(\bar{r})b_j^n(\bar{\theta})}_{\Omega_2} \tag{45}$$

for the two-phase region $\Omega_2$, and $$\hat{\rho}(\bar{r},\bar{\theta}) - \underbrace{\sum_{i\in I_s}\sum_{j\in J_s} c_{ij}b_i^n(\bar{r})b_j^n(\bar{\theta})}_{\Omega_s} = \underbrace{\sum_{i\in I_1}\sum_{j\in J_1} c_{ij}b_i^n(\bar{r})b_j^n(\bar{\theta})}_{\Omega_1} \tag{46}$$

for the region $\Omega_1$. Note that the terms on the left-hand sides of (45) and (46) labeled $\Omega_s$ may be assigned a numerical value given a value for $(\bar{r},\bar{\theta})$. For each element of a set of data $D_2=\{(\bar{r}_i,\bar{\theta}_j): 1\leq i\leq N_2, 1\leq j\leq M_2\}$ over the region $\Omega_2$, where $\bar{r}_i$ and $\bar{\theta}_j$ suitably sample $\Omega_2$, and $N_2$ and $M_2$ are sufficiently large, values of $\rho_{ij}$ are computed using a thermofluid property calculator such as REFPROP, CoolProp, or other similar data source. These values are substituted for $\hat{\rho}$ in equations (45), defining an interpolation or least squares type curve fit problem, which is solved for the unknown coefficients $c_{ij}$ using methods that are well known to those skilled in the art. Similarly, for each element of a set of data $D_1=\{(\bar{r}_i, \bar{\theta}_j):1\leq i\leq N_1\ 1\leq j\leq M_1\}$ over the region $\Omega_1$, where $\bar{r}_i$ and $\bar{\theta}_j$ suitably sample $\Omega_1$, and $N_1$ and $M^1$ are sufficiently large, values of $\rho_{ij}$ are computed using a thermofluid property calculator such as REFPROP, CoolProp, or other similar data source. These values are substituted for $\hat{\rho}$ in equations (46), defining an interpolation or least squares type curve fit problem, which is solved for the unknown coefficients $c_{ij}$ using methods that are well known to those skilled in the art. In this embodiment, $D_1$ and $D_2$ should include both positive and negative values of $\bar{r}$, and then the calculation of $c_{ij}$ in polar coordinates is the same as it in Cartesian coordinates. However, because positive and negative values of $\bar{r}$ are included in the calculation, the domain is essentially covered twice, meaning each element of the data sets $D_1$ and $D_2$ is repeated, and therefore the data curve fit problems for $\Omega_1$ and $\Omega_2$ are solved using a data set that is twice as large as it would need to be for a purely Cartesian problem. While this might be considered inefficient, the calculation of spline coefficients $c_{ij}$ is done off line, and most of the coefficients that correspond to negative values of $\bar{r}$ (except for those near the origin) are not required to be stored for on-line evaluation of the spline function. With values for $c_{ij}$ computed for all three regions, $\hat{\rho}(\bar{r},\bar{\theta})$ is defined on $\Omega$.

Derivative Calculation

Derivatives of $\hat{\rho}$ with respect to the $(\bar{r},\bar{\theta})$ variables may computed from the coefficients and knot points using equation (8), and add marginal overhead to the computational cost of evaluation of the B-spline function $\hat{\rho}$ at a given pair $(\bar{r},\bar{\theta})$. Note that these derivatives are exact; there is no numerical differentiation. Therefore they are consistent. The derivatives of $\hat{\rho}$ with respect to the two input fluid property variables $h_e$ and $P_e$ are computed with the Jacobian of T, denoted DT, $$\begin{bmatrix} \frac{d\hat{\rho}}{dh_e} \\ \frac{d\hat{\rho}}{dP_e} \end{bmatrix} = DT \cdot \begin{bmatrix} \frac{d\hat{\rho}}{d\bar{r}} \\ \frac{d\hat{\rho}}{d\bar{\theta}} \end{bmatrix} = DT_3 \cdot DT_2 \cdot DT_1 \cdot \begin{bmatrix} \frac{d\hat{\rho}}{d\bar{r}} \\ \frac{d\hat{\rho}}{d\bar{\theta}} \end{bmatrix}, \tag{47}$$

where $DT_1$, $DT_2$ and $DT_3$ are the Jacobians of $T_1$, $T_2$ and $T_3$, respectively. Other embodiments provide for calculation of higher-order derivatives of $\hat{\rho}$ with respect to the input fluid property variables $h_e$ and $p_e$ by further differentiating (47) and making use of higher-order derivatives of $\hat{\rho}$ with respect to $\bar{r}$ and $\bar{\theta}$ that may be computed from the normalized polar spline representation.

Normalized Polar Spline Function Calculation

Figure 16:
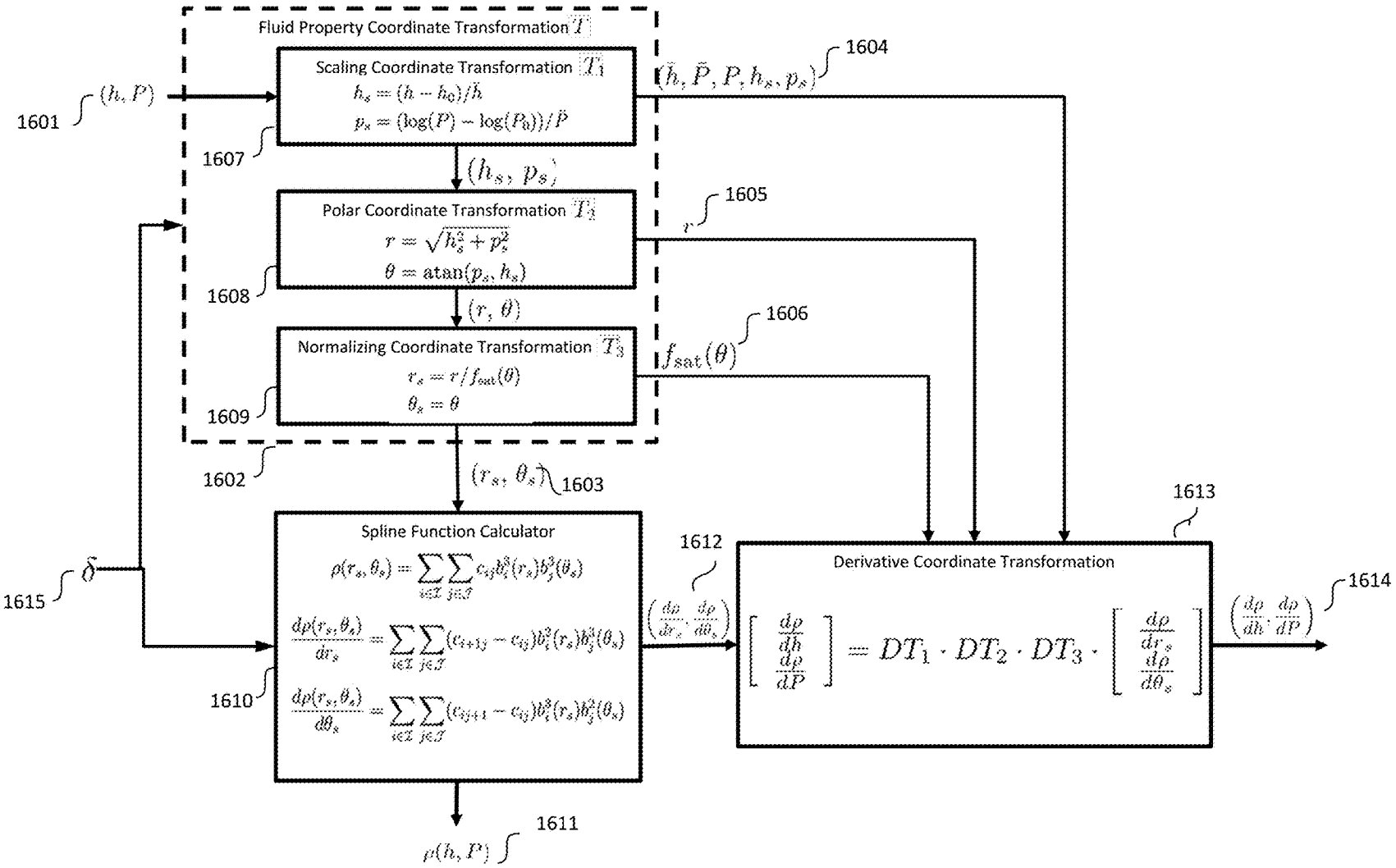
FIG. 16 is a block diagram of the thermofluid property function calculation using the methods of saturation curve-aligned coordinates, for the normalized polar coordinates according to embodiments of the present invention.

FIG. 16 is a block diagram of the thermofluid property function calculation using the methods of saturation curve-aligned coordinates, for the normalized polar coordinates according to some embodiments of the present invention. In the figure, property Coordinate Transformation 1602 acts on two input thermofluid variables 1601 and data 1615 to produce independent thermofluid variables in the saturation curve-aligned coordinates 1603, which are used by the Spline Function Calculator 1610 to compute a value for a third thermofluid property variable 1611 and also values for the thermofluid property function derivatives 1612. These are transformed into the engineering units of the two input thermofluid property variables via the Derivative Coordinate Transformation 1613, which uses the Auxiliary Thermofluid Property Vector 1604, $\bar{r}$ 1605, $\hat{f}_{sat}(\theta)$ 1606 to produce the thermofluid property variable derivatives 1614. The figure describes the normalized polar coordinates of an embodiment. In this case, a pair of input fluid property variables ($h_e$, $P_e$) 1601 is input to the Fluid Property Coordinate Transform T 1602, where it is scaled to (h,e) by the Scaling Coordinate Transformation $T_1$ 1607. Also input into the Scaling Coordinate Transformation $T_1$ 1607 is a data set $\delta$ 1615, which includes scaling factors $h_s$ and $P_S$, the origin ($h_{e0}$, $P_{e0}$), spline function knots and coefficients for $\hat{f}_{sat}$, and spline function knots and coefficients for $\hat{\rho}$. Next, (h,P) is transformed to polar coordinates by the Polar Coordinate Transformation $T_2$ 1608, to produce (r, θ). This pair is input to the Normalizing Coordinate Transformation $T_3$ where fat (e) 1606 is evaluated and used to compute $(\bar{r},\bar{\theta})$ 1603. This is input to the Spline Function Calculator 1610, which evaluates the polar spline function to compute a value for $\hat{\rho}$ 1611, and also derivatives with respect to $\bar{r}$ and $\bar{\theta}$ 1612. The derivatives of $\hat{\rho}$ with respect to $\bar{r}$ and $\bar{\theta}$ 1612 are input to the Derivative Coordinate Transformation 1613, which evaluates and uses the Jacobians of $T_1$, $T_2$ and $T_3$, and also the auxiliary variables 1604, 1604 and 1606, in order to transform the derivatives 1612 to the engineering units of the input fluid property variables 1601, producing derivatives of $\hat{\rho}$ with respect to $h_e$ and $P_e$ 1614.

Figure 17:
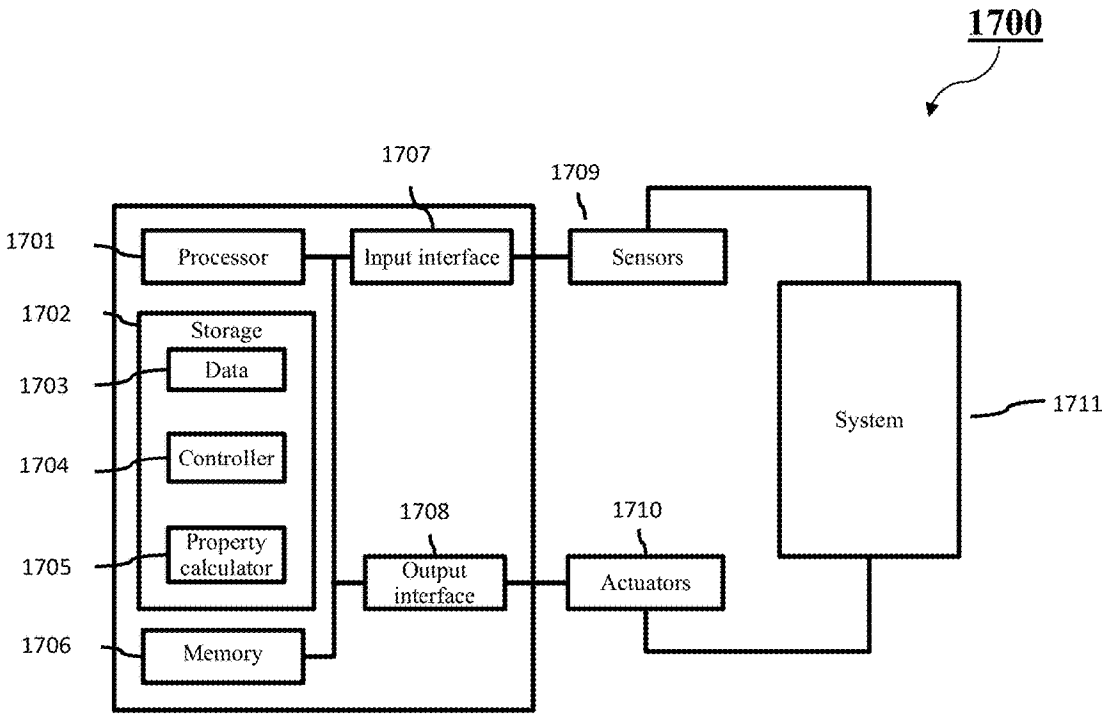
FIG. 17 is a block diagram of a digital computer including the thermofluid property function calculator, according to embodiments of the present invention.

FIG. 17 is a block diagram of a controller/optimizer circuit 1700 that includes a digital computer including the thermofluid property function calculator 1705 according to some embodiments of the present invention.

The figure illustrates a vapor compression cycle (system) 1711 is connected to the controller 1700 via sensors 1709 and actuators 1710. In some cases, the controller circuit 1700 includes an input interface 1707 connected to the sensors 1709, an output interface 1708 connected to the actuators 1710, a processor 1701, a storage 1702 and a memory unit 1706. The storage 1702 can store data 1703, a computer-implemented controller program 1704 and a property calculator (program) 1705. The computer-implemented controller program 1704 can include a thermofluid property calculator, a fluid property Coordinate Transformation (program), a Spline Function Calculator and a Derivative Coordinate Transformation (program).

The input interface 1707 is configured to receive/acquire measurement data from the sensors 1709, and the output interface 1708 is configured to transmit control signals/commands to the actuators 1710 to operate the actuators according to the control parameters (control data) computed based the controller program 1704 using the processor 1701. In some cases, the input interface 1707 and the output interface 1708 may be integrated into a input/output interface.

The vapor compression system 1711 includes valves, compressor, and heat exchangers. In some cases, the vapor compression system 1711 may include variable actuators and also incorporates a controller 1700 that regulates their behavior. The vapor compression cycle (system) 1711 can be configured in a manner similar to the vapor compression system 102 in FIG. 1, which includes, at a minimum, a set of four components, a compressor 103, a condensing heat exchanger 104, an expansion device 106, and an evaporating heat exchanger 107. Heat transfer from the condensing heat exchanger is promoted by use of fan 105, while heat transfer from the evaporating heat exchanger 107 is promoted by the use of fan 108. This system 1711 may include variable actuators that are configured to be used by a controller, such as a variable compressor speed, variable expansion valve position, and variable fan speeds. Of course, there are many other alternate equipment architectures to which this invention pertains with multiple heat exchangers, compressors, valves, and other components such as accumulators or reservoirs, pipes, and so forth, and the discussion of a simple vapor compression cycle is not intended to limit the scope or application of this invention to systems whatsoever. In the disclosure, the equipment is dynamically controlled by instruction commands (digital command data/electrical control signals) that are transmitted from the controller via an output interface 1708. The equipment may be referred to as actuators, such as expansion devices, fans, compressors, valves, etc.

The input and output interfaces 1707 and 1708 provide the facility of exchanging data between the various components of the controller 1700, including processor 1701, storage 1702 with data 1703, controller 1704, and property calculator 1705, and memory 1706. The input and output interfaces may consist of a communication infrastructure such as a controller area network (CAN) bus or other medium that allows data to be physically transferred through serial or parallel communication channels (e.g., copper, wire, optical fiber, computer bus, wireless communication channel, etc.).

In an embodiment, values of measurements of temperatures or pressures at specific places in the cycle, e.g., 109, 110, 111, or 112, are obtained by sensors 1709 and then transmitted over a communication channel and converted into a computer-readable form in the input interface 1707. This computer-readable representation of the input thermofluid properties 804 from the input interface 1707 is then used by the processor 1701 along with the data 1703 (also referred to as 805 in FIG. 8) and property calculator 1705 to calculate fluid properties via the embodiments described in this work from the information obtained from the input interface. The processor then uses these calculated fluid properties to determine updated values for the system actuators, such as a compressor 103, valve position 106, or fan motor speeds 105 or 108 from the controller 1704. These values are then converted from a computer readable form to the electronic form suitable for interfacing to the physical system by the output interface 1708, and are transmitted to the electronic hardware controlling the actuators by a similar communication channel used by the input interface. The electronic hardware controlling the actuators may consist of a power electronic drive for commanding the voltages and currents needed to drive the compressor motor or fan motors at specific speeds, or may consist of commands needed to send a stepper motor in the expansion valve to a specific position. These actuators then change their operating conditions according to these inputs from the controller 1700 and output interface 1708.

The above-described embodiments of the present invention can be implemented using hardware, software, or a combination of hardware and software.

Also, the embodiments of the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

We claim:

1. A control system for controlling a vapor compression system including actuators, comprising:

an input interface configured to receive setpoints of the vapor compression system from a user input and measurement data from sensors arranged in the vapor compression system;

a memory configured to store fluid property data of a fluid flowing in the vapor compression system and computer-executable programs including a thermofluid property calculator, a fluid property coordinate transformation, a spline function calculator and a derivative coordinate transformation, and a processor configured to:

compute, with respect to the setpoints, a pair of input thermofluid property variables from the measurement data or from the stored fluid property data;

compute a pair of independent thermofluid property variables from the pair of input thermofluid property variables using the fluid property coordinate transformation, wherein the computed pair of thermofluid property variables is aligned with a saturation curve;

compute a third thermofluid property variable using the spline function calculator;

compute derivatives of the third thermofluid property variable with respect to the pair of input thermofluid property variables using the spline function calculator and a derivative coordinate transformation;

compute control data from the measurement data and the third thermofluid property variable and the derivatives of the third thermofluid property variable; and transmit, via an output interface, the computed control data including instructions that control the actuators operating the vapor compression system to the vapor compression system.

2. The control system of claim 1, wherein the spline function calculator uses knots of a multiplicity p for the saturation curve aligned coordinate at the saturation curve, wherein the multiplicity p is a degree of a spline function.

3. The control system of claim 1, wherein the spline function calculator uses B-spline functions.

4. The control system of claim 1, wherein the fluid property coordinate transformation uses polar coordinates and the saturation curve is aligned with a normalized radial coordinate.

5. The control system of claim 1, wherein the fluid property coordinate transformation utilizes normalized polar coordinates to approximate a fluid property function represented by $\rho$.

6. The control system of claim 5, wherein the fluid property coordinate transformation uses B-splines.

7. The control system of claim 1, wherein the fluid property coordinate transformation uses cartesian coordinates and the saturation curve is aligned with thermodynamic quality as a coordinate.

8. The control system of claim 1, wherein the fluid property coordinate transformation uses cartesian coordinates to approximate a fluid property function represented by $\rho$.

9. The control system of claim 8, wherein the fluid property coordinate transformation uses B-splines.

10. The control system of claim 1, wherein the actuators are compressors, valves, and fans.

11. The control system of claim 1, wherein the saturation curve is configured to divide a region of interest into a two-phase region and a single-phase region with respect to the fluid.

12. A computer-implemented method for controlling a vapor compression system including actuators, wherein the method uses a processor coupled with stored instructions implementing the method, wherein the instructions, when executed by the processor, carry out at steps of the method, comprising:

receiving setpoints of the vapor compression system from a user input and measurement data from sensors arranged in the vapor compression system;

computing, with respect to the setpoints, a pair of input thermofluid property variables from the measurement data or from fluid property data stored in a memory;

computing a pair of independent thermofluid property variables from the pair of input thermofluid property variables using a fluid property coordinate transformation, wherein the computed pair of thermofluid property variables is aligned with a saturation curve;

computing a third thermofluid property variable using a spline function calculator;

computing derivatives of the third thermofluid property variable with respect to the pair of input thermofluid property variables using the spline function calculator and a derivative coordinate transformation;

computing control data from the measurement data and the third thermofluid property variable and the derivatives of the third thermofluid property variable; and transmitting, via an output interface, the computed control data including instructions that control the actuators operating the vapor compression system to the vapor compression system.

13. The method of claim 12, wherein the spline function calculator uses knots of a multiplicity p for the saturation curve aligned coordinate at the saturation curve, wherein the multiplicity p is a degree of a spline function.

14. The method of claim 12, wherein the spline function calculator uses B-spline functions.

15. The method of claim 12, wherein the fluid property coordinate transformation uses polar coordinates and the saturation curve is aligned with a normalized radial coordinate.

16. The method of claim 12, wherein the fluid property coordinate transformation utilizes normalized polar coordinates to approximate a fluid property function represented by $\rho$.

17. The method of claim 16, wherein the fluid property coordinate transformation uses B-splines.

18. The method of claim 12, wherein the fluid property coordinate transformation uses cartesian coordinates and the saturation curve is aligned with thermodynamic quality as a coordinate.

19. The method of claim 12, wherein the fluid property coordinate transformation uses cartesian coordinates to approximate a fluid property function represented by $\rho$.

20. The method of claim 19, wherein the fluid property coordinate transformation uses B-splines.

21. The method of claim 12, wherein the actuators are compressors, valves, and fans.

22. The method of claim 12, wherein the saturation curve is configured to divide a region of interest into a two-phase region and a single-phase region with respect to the fluid.

* * * * *